US008390832B2

(12) United States Patent
Uematsu

(10) Patent No.: US 8,390,832 B2
(45) Date of Patent: Mar. 5, 2013

(54) PRINTING APPARATUS AND INITIALIZATION METHOD OF THE SAME

(75) Inventor: Takanori Uematsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 852 days.

(21) Appl. No.: 12/554,800

(22) Filed: Sep. 4, 2009

(65) Prior Publication Data

US 2010/0073700 A1 Mar. 25, 2010

(30) Foreign Application Priority Data

Sep. 5, 2008 (JP) ..... 2008-228743

(51) Int. Cl.
*G06F 3/12* (2006.01)
*G06K 15/00* (2006.01)

(52) U.S. Cl. ..... 358/1.13; 358/1; 358/14

(58) Field of Classification Search ..... 358/1.1, 358/1.5, 1.8, 1.9, 1.13, 1.14, 1.15, 1.16, 1, 358/18, 474, 488, 496, 498; 399/9, 16, 18, 399/23, 371, 393, 397, 361, 405; 270/58.08, 270/58.09, 39.01
See application file for complete search history.

(56) References Cited

U.S. PATENT DOCUMENTS

| | | | | |
|---|---|---|---|---|
| 7,017,085 | B2 * | 3/2006 | Braun | 714/47.3 |
| 7,878,723 | B2 * | 2/2011 | Igarashi et al. | 400/582 |
| 8,191,885 | B2 * | 6/2012 | Hattori et al. | 270/58.09 |
| 8,239,051 | B2 * | 8/2012 | Hataida | 700/94 |

FOREIGN PATENT DOCUMENTS

| | | |
|---|---|---|
| JP | 2000-099214 A | 4/2000 |
| JP | 2005-059584 A | 3/2005 |

* cited by examiner

*Primary Examiner* — Gabriel Garcia
(74) *Attorney, Agent, or Firm* — Kilpatrick Townsend & Stockton LLP

(57) ABSTRACT

Provided is a printing apparatus which includes a tray for setting a printing medium thereon and performs an initialization process upon turning on the printing apparatus, the printing apparatus including: an abnormal state detecting section which detects an abnormal state upon performing a power-off process; a first information storing section which stores a detection result of the abnormal state detecting section as first information; a tray position state detecting section which detects a position state of the tray; a tray moving section which moves the tray to a normal position in the case where the position state of the tray is abnormal on the basis of a detection result of the tray position state detecting section upon turning on the printing apparatus; a second information storing section which stores the detection result of the tray position state detecting section as second information.

8 Claims, 12 Drawing Sheets

ACCOMMODATION POSITION

SET POSITION

PRINTING STANDBY POSITION

PRINTING APPARATUS AND INITIALIZATION METHOD OF THE SAME

This application claims priority to Japanese Patent Application No. 2008-228743, filed Sep. 5, 2008, the entirety of which is incorporated by reference herein.

BACKGROUND

1. Technical Field

The present invention relates to a printing apparatus which includes a tray for setting a printing medium thereon, and more particularly, to a printing apparatus which performs an initialization process upon turning on the printing apparatus and an initialization method of the same.

2. Related Art

In recent years, photograph data obtained by a digital camera or image (moving picture) data and voice data obtained by a video camera have been generally written in an optical disk to be stored therein. For example, JP-A-2005-59584 discloses a printer which is capable of printing a title, an image, or the like on a label surface of the optical disk so as to promptly understand the contents of the image or photograph stored in the optical disk. The printer includes a tray which sets the optical disk thereon, and the tray is adapted to move in such a manner that a transport roller rotates by nipping the tray. Also, JP-A-2005-59584 discloses a technology for protecting the disk in such a manner that the transport roller nips the disk placed on the tray.

Further, JP-A-2000-99214 discloses a printer which stores a result of a precedent power-off process in an EEPROM and controls an initialization process in accordance with the result of the precedent power-off process upon turning on the printer at the next time. In detail, when the power-off process is not normally performed, an abnormal end (NG) is set to an end flag showing the result of the power-off process. When a cap is empty, an operation of moving a carriage to a home position and an operation of closing the cap are performed. When the operations are normally performed, the end flag is reset (OK). In addition, in the case where the power-off process of the printer is normally performed and the power-on process thereof is performed, when the end flag is reset (OK), the printer becomes a printing activation state by skipping the initialization process. For this reason, it is possible to shorten the time until the printer becomes the printing activation state after turning on the printer.

However, in the printer including the tray disclosed in JP-A-2005-59584, when the printer is moved or inclined or a vibration is applied to the printer, a problem may arise in that the tray deviates from the normal position (e.g., an accommodation position). Even in the case where the tray is not nipped by a transport roller or the disk set on the tray is nipped by the transport roller, when a comparatively large shock or vibration is applied to the printer, a problem may arise in that the transport roller rotates and the tray deviates from the normal position.

When the tray deviates from the normal position, the initialization process of the tray may not be performed since the tray disturbs the initialization process. Accordingly, in the case where the abnormal position state of the tray is detected by a detector upon turning on the printer, it is necessary to perform the initialization process for the abnormal state even when the power-off process is normally performed. Incidentally, since an operation of performing various initialization items is performed as the initialization process in addition to the operation of moving the carriage to the home position and closing the cap disclosed in JP-A-2000-99214, the number of initialization processes tends to increase with the improvement of the function of the printer.

However, when an all initialization process performing all initialization items is performed due to the deviated state of the tray, a problem arises in that the initialization items, which are not required when the power-off process is normally performed, are performed. As a result, if the tray deviates from the normal position even when the power-off process is normally performed, a predetermined time is required for the initialization process upon turning on the printer, thereby causing a problem in that the printing activation state of the printer cannot be promptly obtained.

SUMMARY

An advantage of some aspects of the invention is that it provides a printing apparatus capable of performing an initialization process in a comparatively simple manner upon turning on the printing apparatus if a power-off process is normally performed even when a tray deviates from a normal position after turning off the printing apparatus, and an initialization method of the printing apparatus.

In order to achieve the above-described object, according to an aspect of the invention, there is provided a printing apparatus which includes a tray for setting a printing medium thereon and performs an initialization process upon turning on the printing apparatus, the printing apparatus including: an abnormal state detecting section which detects an abnormal state upon performing a power-off process; a first information storing section which stores a detection result of the abnormal state detecting section as first information; a tray position state detecting section which detects a position state of the tray; a tray moving section which moves the tray to a normal position in the case where the position state of the tray is abnormal on the basis of a detection result of the tray position state detecting section upon turning on the printing apparatus; a second information storing section which stores the detection result of the tray position state detecting section as second information; and an initialization process performing section which performs a second initialization process, in which a part of initialization items are omitted among plural initialization items of a first initialization process to be performed when the first information is abnormal, in the case where the first information is normal and the second information is abnormal.

With the above-described configuration, the detection result detected by the abnormal state detecting section upon performing the power-off process is stored as the first information in the first information storing section. In the case where the position state of the tray is abnormal on the basis of the detection result of the tray position state detecting section upon turning on the printing apparatus, the tray moving section moves the tray to the normal position. In addition, the detection result of the tray position state detecting section is stored as the second information in the second information storing section. Further, in the case where the first information is normal and the second information is abnormal, the initialization process performing section performs the second initialization process in which a part of the initialization items are omitted among the plural initialization items of the first initialization process to be performed when the first information is abnormal. Accordingly, even in the case where the power-off process is normally performed and the abnormal tray position state upon turning on the printing apparatus is detected due to the tray deviating from the normal position, it is possible to perform the initialization process having comparatively few initialization items upon turning on the printing apparatus.

In the printing apparatus having the above-described configuration, the initialization process performing section may omit an initialization item which is guaranteed when the tray is movable to the normal position, in the second initialization process.

With the above-described configuration, in the second initialization process performed by the initialization process performing section, the initialization item which is guaranteed when the tray is movable to the normal position is omitted. Accordingly, even when the initialization item is omitted, since it is possible to guarantee the operation result of the initialization item omitted when the tray is movable to the normal position, no problem arises even when the initialization item is omitted.

In the printing apparatus having the above-described configuration, in the case where the first information is normal and the second information is normal, the initialization process performing section may perform a third initialization process in which a part of initialization items are omitted among the plural initialization items of the first initialization process, and in the second initialization process, the initialization process performing section may perform a part of initialization items among the initialization items omitted in the third initialization process.

With the above-described configuration, in the second initialization process, a part of the initialization items, omitted among the initialization items in the third initialization process performed by the initialization process performing section when the first information is normal and the second information is normal, are performed. Accordingly, since the initialization process, which cannot be sufficiently guaranteed by the fact that the tray deviating from the normal position is moved to the normal position, is performed, it is possible to efficiently prevent an error caused upon neglecting the initialization process which cannot be guaranteed by the fact that the tray is moved to the normal position.

In the printing apparatus having the above-described configuration, the printing apparatus further includes: a transport section which transports a second soft printing medium as the printing medium; a common power source which drives the tray and the transport section; a printing section which performs a printing process on a first printing medium and the second printing medium; and a position detecting section which is provided at a position capable of detecting the tray and the second printing medium, wherein the tray may be used to set the first rigid printing medium as the printing medium thereon, wherein a movement path of the tray and a transport path of the second printing medium using the transport section are joined at a position right before the printing section so as to form a common path, and wherein the initialization item omitted in the third initialization process and performed in the second initialization process may be a discharge reset operation of driving the power source so as to perform a discharge operation using the transport section and checks whether the transport path is empty after the discharge operation on the basis of a detection result of the position detecting section.

With the above-described configuration, the discharge reset operation is performed which drives the power source to perform the discharge operation using the transport section and checks whether the transport path is empty on the basis of the detection result of the position detecting section. Accordingly, in the case where the tray deviating from the normal position arrives at the common path or a position detected by the position detecting section, the position detecting section is in a detection state, but it is not possible to guarantee that an alien material except for the tray does not exist on the transport path on the basis of the fact that the tray is moved to the normal position. However, when the discharge reset operation is performed, it is possible to guarantee that the alien material does not exist on the transport path.

In the printing apparatus having the above-described configuration, the abnormal state detecting section may detect the abnormal state when at least one of a fatal error, a plug-out state, and a power-off failure is generated.

With the above-described configuration, at the time of performing the power-off process, the abnormal state detecting section detects the abnormal state when at least one of the fatal error, the plug-out state, and the power-off failure is generated. Accordingly, when the abnormal state requiring the first initialization process is appropriately detected upon turning on the printing apparatus and the first initialization process is performed upon turning on the printing apparatus, it is possible to prevent occurrence of an error as much as possible.

In the printing apparatus having the above-described configuration, the printing apparatus further includes a gap adjusting section which moves the printing section so as to adjust a gap between the printing section and the printing medium, wherein the initialization item omitted when the tray is movable to the normal position may be a gap adjusting section reset operation of retreating the printing section to an end position so as not to interfere with the tray.

With the above-described configuration, the fact that the tray is movable to the normal position guarantees that the printing section retreats to the end position so as not to interfere with the tray. For this reason, in the second initialization process, the gap adjusting section reset operation of retreating the printing section to the end position so as not to interfere with the tray is omitted. Accordingly, since the gap adjusting section reset operation is omitted, the initialization process is promptly performed and the printing apparatus promptly becomes the printing activation state.

In the printing apparatus having the above-described configuration, the printing apparatus further includes a discharge opening adjusting section which moves a movable member, adjusting a height of a discharge opening used to discharge the printing medium having been subjected to the printing process of the printing section, in a thickness direction of the printing medium, wherein the initialization item omitted when the tray is movable to the normal position may be a discharge opening adjusting section reset operation of retreating the movable member to an end position so as not to interfere with the tray.

With the above-described configuration, the fact that the tray is movable to the normal position guarantees that the movable member retreats to the end position so as not to interfere with the tray. For this reason, in the second initialization process, the discharge opening adjusting section reset operation of retreating the movable member to the end position so as not to interfere with the tray is omitted. Accordingly, since the discharge opening adjusting section reset operation is omitted, the initialization process is promptly performed and the printing apparatus promptly becomes the printing activation state.

According to another aspect of the invention, there is provided an initialization method of a printing apparatus which includes a tray for setting a printing medium thereon and performs an initialization process upon turning on the printing apparatus, the initialization method including: an abnormal state detecting step of detecting an abnormal state upon performing a power-off process; a first storage step of storing a detection result of the abnormal state detecting step as first information in a first information storing section; a tray position state detecting step of detecting a position state of the tray upon turning on the printing apparatus; a tray moving step of moving the tray to a normal position in the case where the position state of the tray is abnormal on the basis of a detection result of the tray position state detecting step; a second storage step of storing the detection result of the tray position state detecting step as second information in a second information storing section; and an initialization process performing step of performing a second initialization process, in which a part of initialization items are omitted among plural initialization items of a first initialization process to be performed when the first information is abnormal, in the case where the first information is normal and the second information is abnormal.

With the above-described configuration, it is possible to obtain the same advantage as that of the printing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of an ink jet multi-functional printer as one of various types of printing apparatuses will be described with reference to FIGS. 1 to 12.

Figure 1:
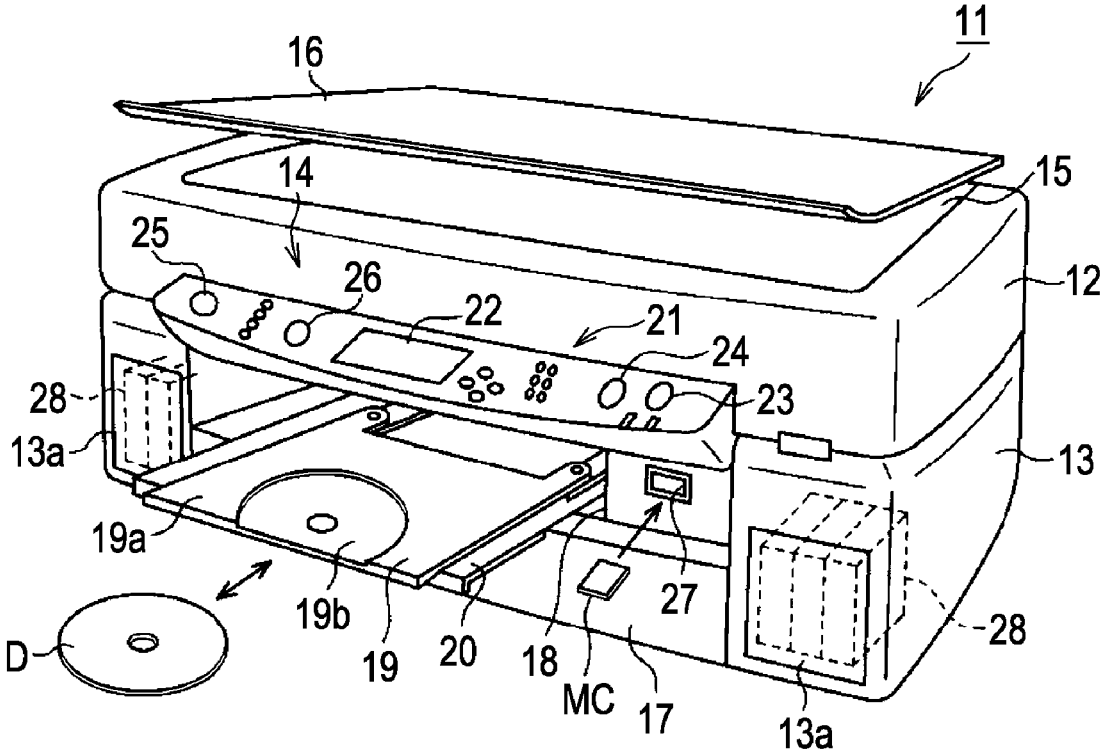
FIG. 1 is a perspective view showing a multi-functional printer according to an embodiment.

As shown in FIG. 1, one unit of the ink jet multi-functional printer (hereinafter, simply referred to as "a printer 11") corresponds to a color printer having three functions of a scanner, a printer, and a copier. The printer 11 includes a scanner unit 12 which reads an image of a document and inputs the image as image data, a printer unit 13 which prints an image based on print data on a predetermined printing medium (media), and a manipulation panel 14. The copy function is realized in such a manner that the image data read by the scanner unit 12 is converted into the print data by the printer unit 13 and the image based on the print data is printed by the printer unit 13.

The scanner unit 12 is disposed on the upper side of the printer unit 13, and the upper portion of the scanner unit 12 is provided with a document table glass 15 on which a document is placed and a document table cover 16 which covers the document table glass 15. The document table cover 16 is provided in the scanner unit 12 so as to be openable or closeable.

A paper sheet feeding cassette 17 which accommodates a paper sheet P (printing medium) to be fed to the printer unit 13 is inserted into the lower portion of the printer 11 so as to be detachable therefrom. The upper portion of the paper sheet feeding cassette 17 is provided with a discharge portion 18 which discharges the paper sheet P printed by the printer unit 13. In the printer 11 according to the embodiment, in order to perform a printing process on a label surface of an optical disk (hereinafter, simply referred to as "a disk D") such as a CD-R or a DVD-R, a disk holding tray (hereinafter, simply referred to as "a tray 19") which places (sets) the disk D thereon is provided in an opening of the discharge portion 18 so as to be drawn out therefrom. A substantially square-plate-shaped tray body 19*a* of the tray 19 is provided with a substantially annular set concave portion 19*b* which sets the disk D thereon. In addition, FIG. 1 shows the state where the tray 19 is located at a set position in which the disk D is set on or extracted from the tray 19, and a three-stage telescopic paper sheet discharging stacker 20 is provided below the tray 19 so as to place the paper sheet, discharged to the discharge portion 18, thereon.

The manipulation panel 14 located at a position adjacent to the substantially upper end of the front surface of the printer 11 includes a manipulation portion 21 which is manipulated by a user and a display portion 22 which performs various displays thereon. The display portion 22 is formed by, for example, a color liquid crystal display. The display portion 22 displays a menu screen, a text showing operation states and setting states for various modes, or an image used to select a print object image or to check the print image on the screen.

The manipulation portion 21 is provided with manipulation buttons enables the user to perform various manipulations. For example, as the manipulation buttons, a selection button for selecting various menus, a mode selection button, and the like are provided in addition to a power switch 23 (power button) for turning on or off a power source, a print start button 24 for starting a printing process, a copy button 25 for starting a copy process, a tray open-close button 26 for drawing out the tray 19, and the like. For example, a label print is performed in such a manner that a label print mode is selected by the mode selection button, a required setting item (a CD size, an image selection, and the like) is selected on the setting screen, and the print start button 24 is pushed.

In addition, a card slot 27 is provided on the right side of the front surface of the printer 11. For example, when a memory card MC storing therein an image captured by a digital camera or the like is inserted into the card slot 27, it is possible to print the image stored in the memory card MC without using a host device such as a personal computer. Further, the printer 11 includes a USB port (not shown) used to be connected to a terminal of a USB cable. Accordingly, it is possible to perform a printing process by directly reading the image data from the digital camera via the USB cable. Also, it is possible to perform the printing process on the basis of the image data received from a printer driver of the host device via the USB cable. Furthermore, plural ink cartridges 28 are provided in the lower portions on the left and right sides of the front part of the printer 11 so as to be covered by a cover 13*a* and to be accommodated in a cartridge holder (not shown) in a connected state.

Figure 2:
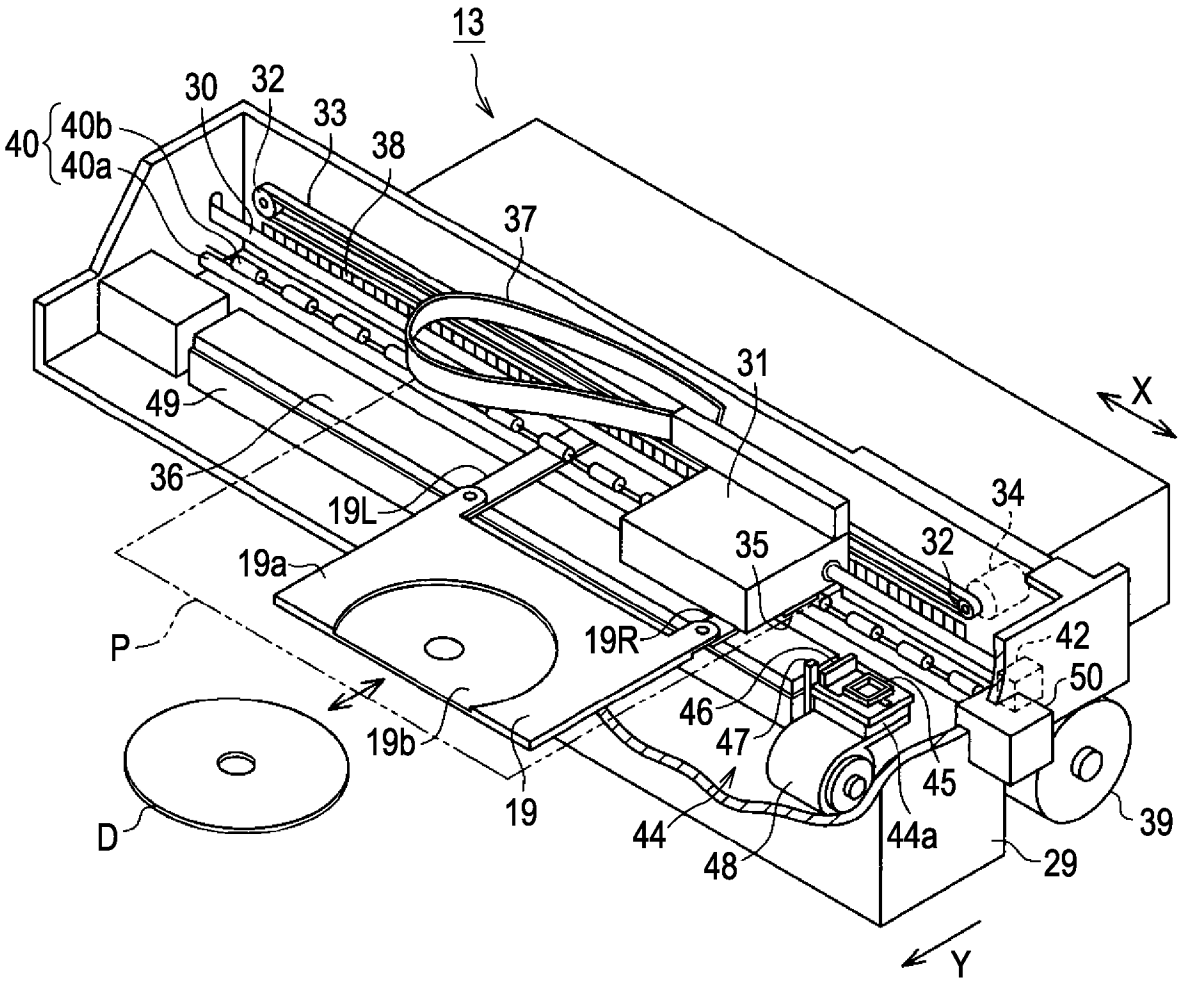
FIG. 2 is a perspective view showing a printer unit.

Next, the configuration of the printer unit will be described. FIG. 2 is a perspective view showing the printer unit.

As shown in FIG. 2, the printer unit 13 includes a substantially square-box-shaped body frame 29 of which the upper and lower portions thereof are opened. In the same drawing, a guide shaft 30 having a predetermined length is provided between left and right side walls of the body frame 29, and a carriage 31 is adapted to be movable in a reciprocating manner along the guide shaft 30 in a main scanning direction X. The carriage 31 is fixed to an endless-shaped timing belt 33 which is wound on a pair of pulleys 32 attached to the inner surface of the rear plate of the body frame 29. When the timing belt 33 rotates in a normal direction or a reverse direction in accordance with a normal or reverse rotation of a carriage motor (hereinafter, referred to as "a CR motor 34") attached to a driving shaft of the pulley 32 located on the right side in FIG. 2, the carriage 31 moves in a reciprocating manner in the main scanning direction X.

An ink jet printing head 35 is provided in the lower portion of the carriage 31, and the lower surface of the printing head 35 is formed as a nozzle formation surface 35*a* (see FIG. 3) where plural rows of nozzles are opened so as to eject liquid as ink.

In the body frame 29, a platen 36 is provided at a position facing the printing head 35 so as to regulate a gap between the printing head 35 and the paper sheet. In addition, the printing head 35 is connected to the plural ink cartridges 28 via a flexible piping plate 37 in which plural ink supply tubes for ink colors are provided in a collected state. For example, each ink of four colors of black (K), cyan (C), magenta (M), and yellow (Y) is individually supplied from each ink cartridge 28 to the printing head 35. In addition, the flexible piping plate 37 includes an electric wiring for driving the printing head 35. Further, the rear surface of the carriage 31 is provided with a linear encoder 38 which outputs the number of pulses in proportional to the movement amount of the carriage 31, where the linear encoder 38 extends along the guide shaft 30.

In FIG. 2, the lower portion on the right side of the body frame 29 is provided with a paper sheet feeding motor (hereinafter, referred to as "a PF motor 39"). When the PF motor 39 is driven, a pair of transport rollers 40 and a pair of discharge rollers 41 (see FIG. 3) respectively disposed on the upstream side and the downstream side in a transport direction with the platen 36 interposed therebetween are rotationally driven to thereby transport the paper sheet P of the tray 19 in a sub-scanning direction Y. At this time, when the PF motor 39 is driven in the normal or reverse direction in the state where the tray body 19*a* or a pair of guide arms 19L and 19R is nipped by the pair of transport rollers 40, the tray 19 is drawn out in the sub-scanning direction Y (transport direction). In addition, upon performing the printing process on the paper sheet P, the tray 19 retreats to an accommodation position on the upstream side of the pair of transport rollers 40 in the transport direction so as not to interfere with a paper sheet transport path to be described later. Further, the pair of transport rollers 40 includes a transport driving roller 40*a* which is rotationally driven by power of the PF motor 39 and a driven roller 40*b* which is rotated by coming into contact with the transport driving roller 40*a*.

When the printing process and the transporting process are alternately performed by reciprocating the carriage 31 in the sub-scanning direction X, the image or text is printed on the paper sheet P or the disk D, where the printing process is a process in which ink is ejected from the nozzle of the printing head 35 onto the label surface of the paper sheet P or the disk D, and the transporting process is a process in which the paper sheet P or the disk D is transported by a predetermined transport amount in the sub-scanning direction Y.

Further, the printer 11 includes an automatic platen gap adjusting device (hereinafter, referred to as "an APG device 42") which moves the carriage 31 in the vertical direction so as to adjust a gap between the printing head 35 and the platen 36 (platen gap). On the basis of information on the type of the paper sheet obtained from the host device or the setting information of the manipulation panel 14, the APG device 42 is driven so as to ensure the appropriate platen gap in accordance with the type of the paper sheet, so that the carriage 31 is adjusted to be located at a height capable of ensuring a predetermined paper gap (a gap between the printing head 35 and the paper sheet). In addition, during the label printing process, the APG device 42 is driven so as to ensure a wide platen gap in accordance with a thickness of the disk D, so that the carriage 31 is located at, for example, a maximum ascending position. Further, in the embodiment, the APG device 42 constitutes a gap adjusting section.

In FIG. 2, a right end position of a movement path of the carriage 31 is set to a home position where the carriage 31 is located when the printing process is not performed. A capping device 44 (maintenance unit) is disposed right below the carriage 31 located at the home position so as to perform a maintenance process such as a nozzle cleaning on the printing head 35.

The capping device 44 includes a cap 45 which is a cover member for preventing ink inside the nozzle of the printing head 35 from being dried, a wiper 46 which cleans the nozzle formation surface 35*a*, a lock member 47 which locks the carriage 31 so as to be located at the home position, an elevation mechanism 44*a* which elevates the respective members 45, 46, and 47, and a suction pump 48. By means of the elevation mechanism 44*a*, the respective members 45, 46, and 47 elevate between an ascending position and a receding position (maximum descending position) where the printing head 35 is not interfered. At the ascending position, the cap 45 comes into contact with the nozzle formation surface 35*a* of the printing head 35 so as to surround the nozzle, and the wiper 46 is located at a position capable of cleaning the nozzle formation 35*a*. Also, the lock member 47 engages with a locking concave portion (not shown) of the carriage 31 so that the carriage 31 is locked to the home position.

In addition to the function (capping function) of the cover member for preventing the nozzle opening from being dried, the cap 45 functions as a part of a liquid suction mechanism for compulsorily sucking ink from the nozzle and discharging the ink to the outside in such a manner that the cap 45 caps the nozzle formation surface 35*a* of the printing head 35 and a negative pressure generated by the suction pump 48 is applied to a space inside the cap. The suction pump 48 includes, for example, a tube pump, where waste ink sucked from the nozzle and discharged to the inside of the cap 45 is discharged to a waste water tank 49 disposed on the lower side of the platen 36.

In addition, a power transmission switching device 50 is provided in the vicinity of the home position of the carriage 31. When the carriage 31 is located at a switching position in the vicinity of the home position, a connection state of the power transmission switching device 50 is switched to a disconnection state, and a connection position (switching position) is selected in accordance with the rotation of the transport driving roller 40*a*. When the carriage 31 retreats from the switching position, a connection position selecting a power transmission path of the PF motor 39 is selected. In the embodiment, the PF motor 39 is used as the common power source for the APG device 42, the capping device 44, an automatic feeding device (hereinafter, simply referred to as "a feeding device 52") (see FIG. 3), and an elevation device (see FIGS. 9A, 9B, and 9C) of a medium discharging frame (hereinafter, referred to as "an EJ frame 125"). In addition, when the switching operation of the power transmission switching device 50 is performed, one of the power transmission paths of the devices 42, 44, 52, and the like is selected. Further, the power transmission path from the PF motor 39 to the pair of transport rollers 40 and the pair of discharge rollers 41 is always in a connection state irrespective of the switching position of the power transmission switching device 50.

Figure 3:
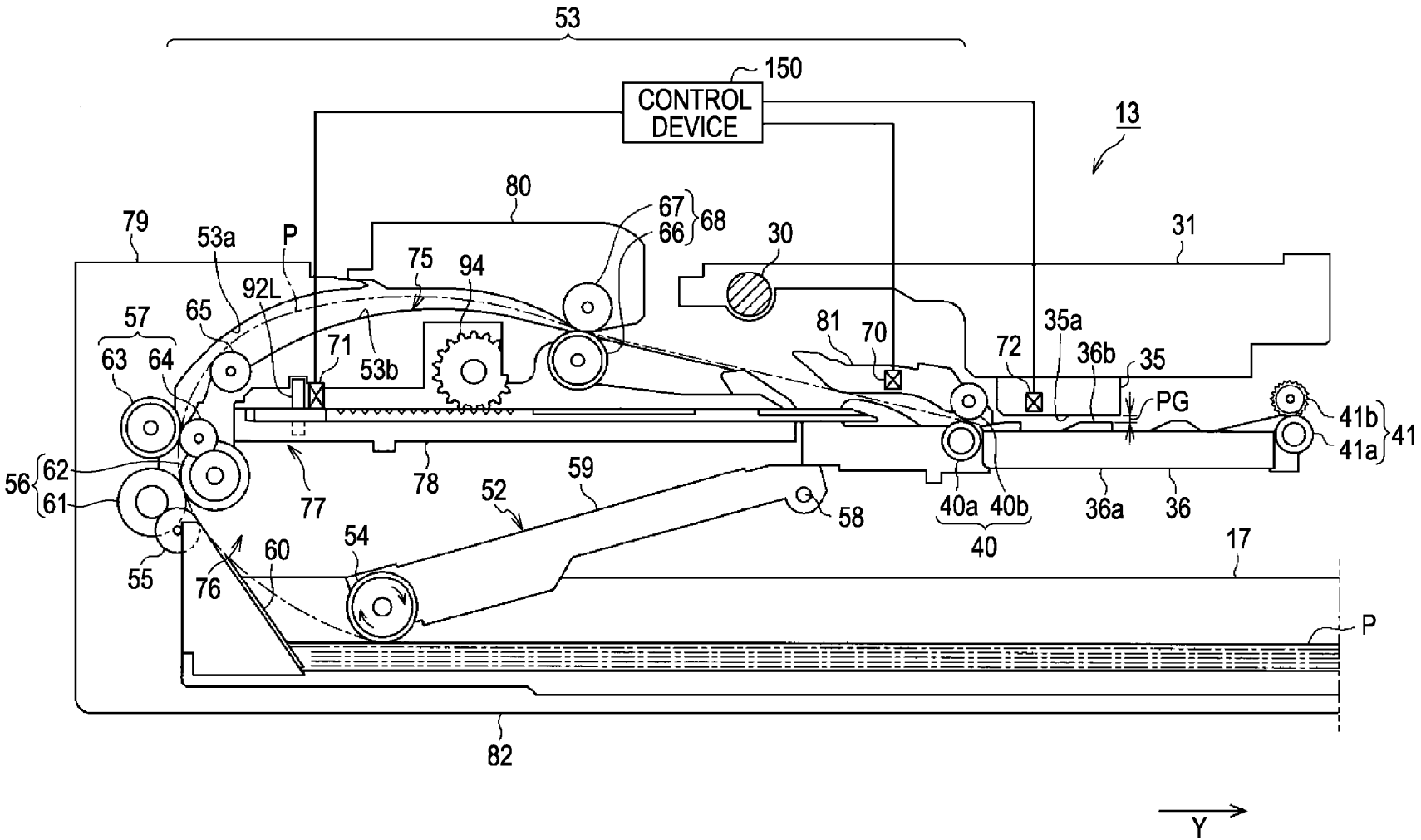
FIG. 3 is a side view showing the printer unit.

Next, the detailed configuration of the printer unit 13 will be described. FIG. 3 is a schematic side cross-sectional view showing an inner structure of the printer in the state where the tray is located at the accommodation position. The paper sheet feeding cassette 17 is detachably attached to the lower portion of the center portion of the front surface 13*b* of the printer unit 13 so as to accommodate plural sheets of paper sheets P in a piled state. The paper sheets P accommodated in the paper sheet feeding cassette 17 are sequentially sent out one by one from the uppermost paper sheet P by a feeding device 52 so as to be fed to a U-shaped curved inverse path 53 to be described later.

The feeding device 52 includes the paper sheet feeding cassette 17, a pickup roller 54, a guide roller 55, a separator 56, and a first intermediate transport roller 57. The paper sheet feeding cassette 17 is capable of setting plural sheets of paper sheets P in a piled state, and the accommodated paper sheets P are positioned to a feeding position by an edge guide (not shown).

The pickup roller 54 is provided in a swinging member 59 which swings about a swing shaft 58. When the pickup roller 54 rotates using the PF motor 39 (see FIG. 2) as a power source by coming into contact with the uppermost paper sheet P set in the paper sheet feeding cassette 17, the uppermost paper sheet P is sent out from the paper sheet feeding cassette 17.

When the front end portion of the paper sheet P sent out by the rotation of the pickup roller 54 moves to the downstream side while coming into contact with a separation slope surface 60, the paper sheet P sent out from the paper sheet feeding cassette 17 is preliminarily separated from the next paper sheet P. The rotatable guide roller 55 is provided on the downstream side of the separation slope surface 60, and a separation member 56 including a separation roller 61 and a driving roller 62 is provided on the downstream side of the guide roller 55. In the separation roller 61, the outer peripheral surface formed of an elastic material comes into pressing contact with the driving roller 62, and is applied with a predetermined rotation resistance by using a torque limiter mechanism. Accordingly, the next paper sheet P stops between the separation roller 61 and the driving roller 62, thereby preventing a sheet overlapping feeding phenomenon.

A first intermediate transport roller 57 is provided on the downstream side of the separation member 56, and includes a driving roller 63 and an assist roller 64 rotated in a following manner by nipping the paper sheet P between itself and the driving roller 63. The paper sheet P is sent further to the downstream side by the first intermediate transport roller 57. In addition, a driven roller 65 is provided on the downstream side of the first intermediate transport roller 57 so as to reduce a load generated when the paper sheet P passes through the curved inverse path 53.

Further, a second intermediate transport roller 68 is provided on the downstream side of the feeding device 52 (driven roller 65), and includes a driving roller 66 and an assist roller 67 rotated in a following manner by nipping the paper sheet P between itself and the driving roller 66. The paper sheet P is sent further to the downstream side by the second intermediate transport roller 68. In addition, in the embodiment, the pickup roller 54, the guide roller 55, the separation member 56, the first intermediate transport roller 57, the second intermediate transport roller 68, and the like constitute a transport mechanism.

The pair of transport rollers 40, the printing head 35, the platen 36, and the pair of discharge rollers 41 are provided on the downstream side of the second intermediate transport roller 68. In addition, a position detector 70 (paper sheet detecting sensor) as a detection mechanism is provided in the vicinity of the upstream side of the pair of transport rollers 40 so as to detect the paper sheet P or the tray 19. The position detector 70 detects the passage state of the front end portion of the fed paper sheet P or the rear end portion of the transported paper sheet P, and detects the passage state of a reference position (original point) of the tray 19 when the tray 19 moves. In the embodiment, the position detector 70 includes, for example, an optical sensor. Of course, the position detector 70 may be formed as a contact-type sensor.

In the state where paper sheet P is nipped between the transport driving roller 40*a* and the driven roller 40*b*, the feeding operation of the paper sheet P is continued (the position of the front end portion of the paper sheet P is adjusted) until the front end portion of the paper sheet P arrives at a print start position, and then the paper sheet P is precisely transported to the downstream side during the feeding operation of the paper sheet P after starting the printing process.

In the state where the carriage 31 is guided along the guide shaft 30 extending in the main scanning direction (a direction perpendicular to FIG. 3), the carriage 31 is driven by the CR motor 34 (FIG. 2) so as to reciprocate in the main scanning direction. In addition, the carriage 31 is of a so-called off carriage type in which the ink cartridge is not loaded. Ink is supplied from the ink cartridges 28 (FIG. 1) to the printing head 35 via an ink supply tube (not shown) of the flexible piping plate 37.

The platen 36 is provided at a position facing the printing head 35, and a gap PG between the paper sheet P and the printing head 35 is regulated by the platen 36. In addition, in the embodiment, the gap PG is changed to four stages by the APG device 42 (shown in FIG. 8).

The pair of discharge rollers 41 provided on the downstream side of the platen 36 in the transport direction includes the driving roller 41*a* and the driven roller 41*b* rotated in a following manner by coming into contact with the driving roller 41*a*. The paper sheet P having been subjected to the printing process of the printing head 35 is discharged to the paper sheet discharging stacker 20 (see FIG. 1) provided on the front side of the printer by the pair of discharge rollers 41. In addition, the pickup roller 54, the driving roller 62, the driving roller 63, and the driving roller 66 constituting the feeding device 52 are rotationally driven by the power of the PF motor 39.

The printer 11 includes a tray accommodation detector 71 and a paper sheet width sensor 72 in addition to the position detector 70. Among the sensor and detectors, the tray accommodation detector 71 is a contact-type mechanical detector, and detects whether the tray 19 is located at the accommodation position shown in FIG. 3. In detail, the tray accommodation detector 71 is disposed on the upstream side of the tray 19 located at the accommodation position in the transport direction during the printing process. The tray accommodation detector 71 detects the tray 19 in such a manner that a detection contact member (not shown) comes into contact with the tray 19.

In addition, the paper sheet width sensor 72 is an optical sensor, and is provided in the carriage 31 so as to be located at a position adjacent to the printing head 35. When the carriage 31 moves in the main scanning direction X, the paper sheet width sensor 72 emits light and receives reflected light of the emitted light. Then, the end portion or the existence of the disk D placed on the tray 19 and the paper sheet P is detected by the paper sheet width sensor 72 in consideration of a degree of reflectivity. The position detector 70, the tray accommodation detector 71, and the paper sheet width sensor 72 are respectively configured to transmit signals for informing the detection states to a control device 150. In addition, in some cases, the home position in the movement direction (main scanning direction X) of the carriage 31 is referred to as "one digit side", and the opposite home position is referred to as "eighty digit side".

As shown in FIG. 3, the size of the tray 19 accommodated in an inner space 76 of a path forming member 75 forming the curved inverse path 53 is short. In order to move the tray 19 to the set position, an extending movement mechanism 77 which extends a movement stroke is connected to the rear end portion of the tray body 19*a*. In addition, a support member 78 for supporting the rear surface (lower surface) of the tray 19 is incorporated into the path forming member 75.

The curved inverse path 53 is provided by means of the rear space of the printer unit 13. The curved inverse path 53 includes upper housings 79 and 80 which form an outer guide surface 53*a*, a transport guide 81, a lower housing 82 located below the upper housings 79 and 80, and the path forming member 75 forming an inner guide surface 53*b*.

Figure 4:
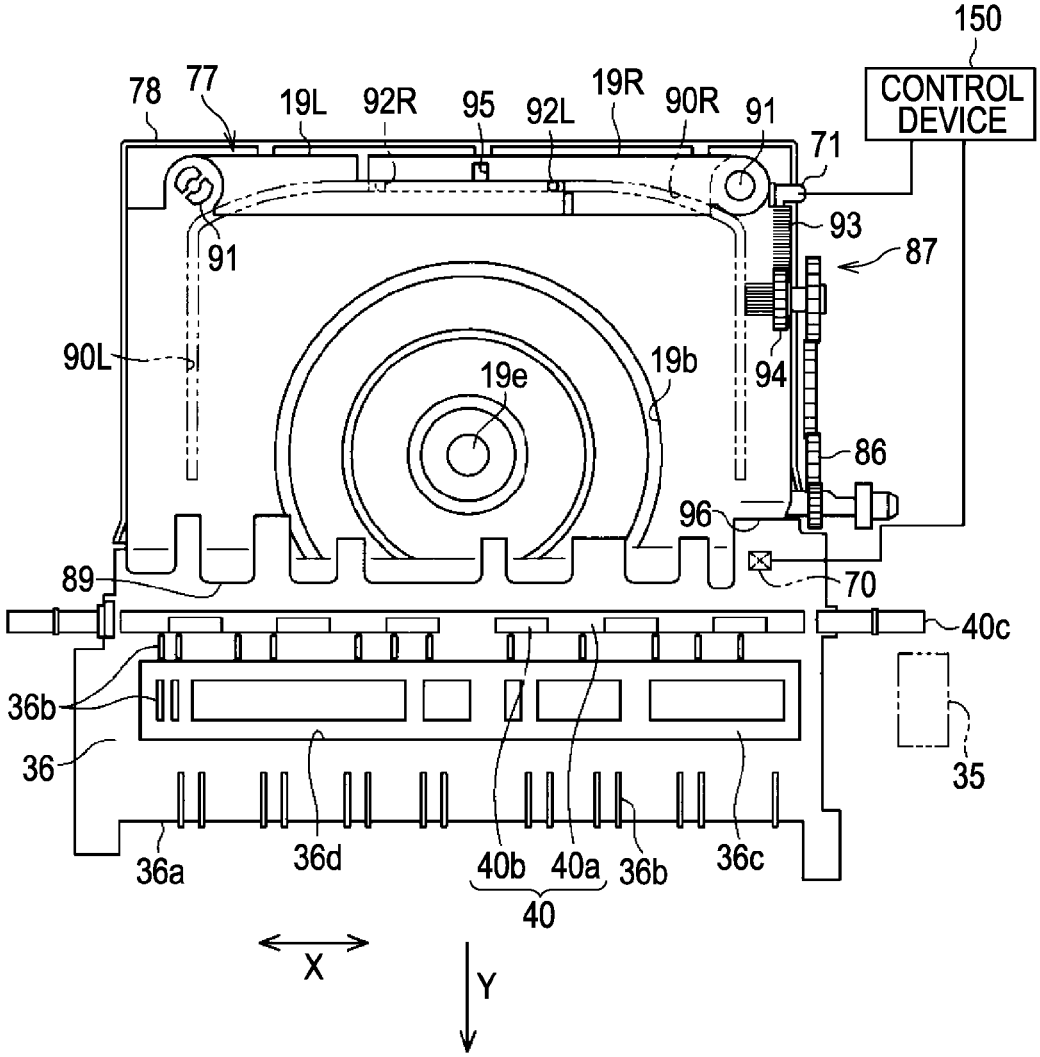
FIG. 4 is a plane view showing the vicinity of a tray located at an accommodation position.

FIG. 4 is a plane view showing the vicinity of the tray 19 located at the accommodation position. As shown in FIG. 4, at a position adjacent to a slight front position (lower position in FIG. 4) of the central position of the width direction (transverse direction in FIG. 4) of the upper surface of the tray body 19*a* of the tray 19, there are provided a set concave portion 19*b* which sets the disk D thereon and a holding convex portion 19*e* which holds the set disk D in a center hole thereof. In addition, an example of the disk D which can be set on the tray 19 includes a blue-ray disk which gains attention as a next generation optical disk, a CD-R, a CD-RW, a DVD-R, or a DVD-RW having a diameter of 12 cm or 8 cm in addition to various optical disks to be developed later.

As shown in FIG. 4, the front end portion of the tray 19 is provided with a slope guide claw 89 formed in a comb shape in which the front portion of the guide claw 89 is low. When the tray 19 advances from the accommodation position, the guide claw 89 is smoothly inserted between the pair of transport rollers 40. In addition, the extension movement mechanism 77 connected to the rear end portion of the tray 19 includes foldable guide arms 19L and 19R which are rotatably connected to the tray 19 and guide rails 90L and 90R which guide the posture and movement of the guide arms 19L and 19R. The guide arms 19L and 19R are respectively formed as elongate flat members having a narrow width, and the base end portions thereof are rotatably connected to the left and right end portions of the rear edge of the tray body 19*a* via a rotary shaft 91, respectively.

Further, the front end portions of the guide arms 19L and 19R are respectively provided with a guide pin 92L which protrudes upward from the left guide arm 19L and a guide pin 92R which protrudes downward from the right guide arm 19R. In addition, the guide pin 92L engages with an L-shaped guide rail 90L which is provided in the inner peripheral surface of the path forming member 75, and the guide pin 92R engages with a bilaterally symmetric L-shaped guide rail 90R which is provided in the upper surface of the support member 78.

A detection target hole 95 (set position hole) is formed at a position adjacent to the front end portion of the right guide arm 19R. In addition, the right end of the front edge of the tray body 19*a* is provided with a notch portion 96. The detection target hole 95 and the notch portion 96 correspond to a detection target of the position detector 70. When the tray 19 moves, the position detector 70 is separated from the notch portion 96 and detects the tray body 19*a*. Then, a position at the time when the detection signal is changed from an off state to an on state is set to the reference position of the tray 19. In addition, a position at the time when the position detector 70 detects the detection target hole 95 is set to the set position of the tray 19.

The power of the PF motor 39 (FIG. 2) is transmitted to a roller driving shaft 40*c* shown in FIG. 4, and is transmitted to an auxiliary transport mechanism 87 via a gear wheel row 86. The auxiliary transport mechanism 87 is formed by a rack and pinion mechanism, and includes a rack 93 which is provided in the rear portion of the right edge of the upper surface of the tray body 19*a* and a pinion 94 which is provided in the terminal end portion of the gear wheel row 86 for transmitting the power of the roller driving shaft 40*c*.

The movement of the tray 19 in the transport direction Y and the opposite transport direction −Y is performed by the auxiliary transport mechanism 87 and the pair of transport rollers 40. The auxiliary transport mechanism 87 performs the movement of the tray 19 between the accommodation position and the printing standby position (FIG. 5C) and the movement of the tray 19 between the printing standby position and the accommodation position. In addition, the movement of the tray 19 between the printing standby position (FIG. 5C) and the set position (FIGS. 1, 2, and 5A) is performed by the rotation of the pair of transport rollers 40 nipping the tray 19.

That is, when the power of the roller driving shaft 40*c* is transmitted to the rack 93 of the tray 19 located at the accommodation position in FIG. 4 via the gear wheel row 86 and the pinion 94, the tray 19 starts to move forward. When the guide claw 89 of the front end portion of the tray 19 arrives at the nip point of the pair of transport rollers 40, the power transmission from the auxiliary transport mechanism 87 ends, and the tray 19 arrives at the printing standby position (FIG. 5C) where the power of the pair of transport rollers 40 is transmitted to the tray 19. In addition, since the printing process is performed on the label surface of the disk D in the case of using the tray 19, the APG device 42 is operated in advance so as to set the gap PG for the disk D by enlarging the gap between the printing head 35 and the platen 36.

Further, as shown in FIG. 4, the platen 36 includes a transport guide portion 36*a* which is a support member, a platen rib 36*b* which is formed in the upper surface of the transport guide portion 36*a*, and an ink collecting groove 36*d* which is exposed in an absorbing member 36*c* for absorbing excessive ink which is not used in the printing process (all of them are shown in FIG. 4).

Figure 5A:
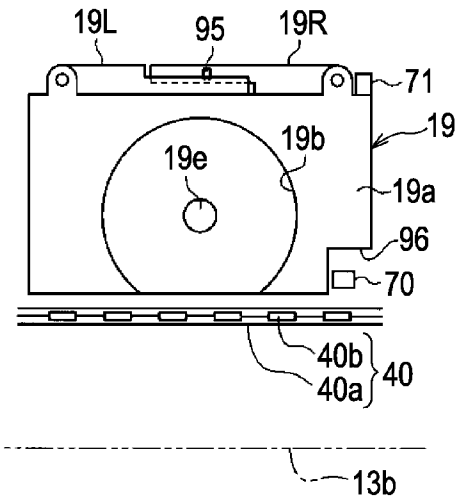
FIGS. 5A, 5B, and 5C are schematic plane views illustrating an operation of the tray.
Figure 5B:
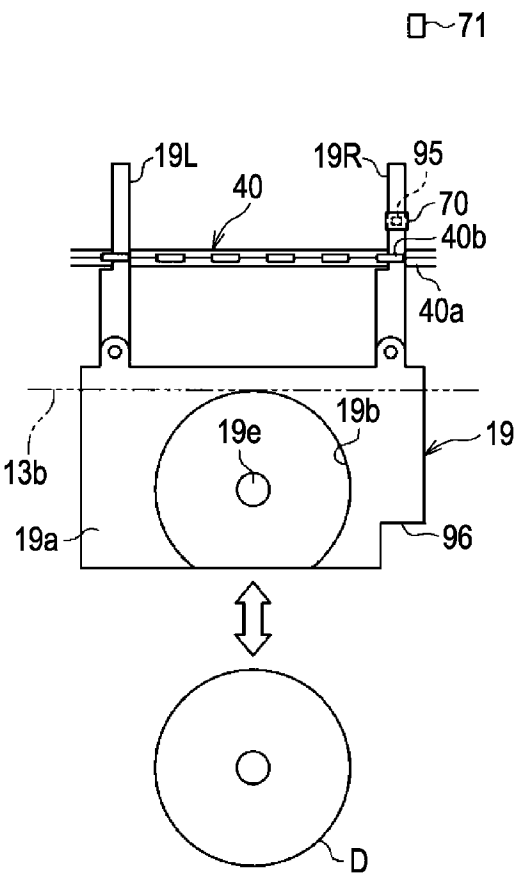
Figure 5C:
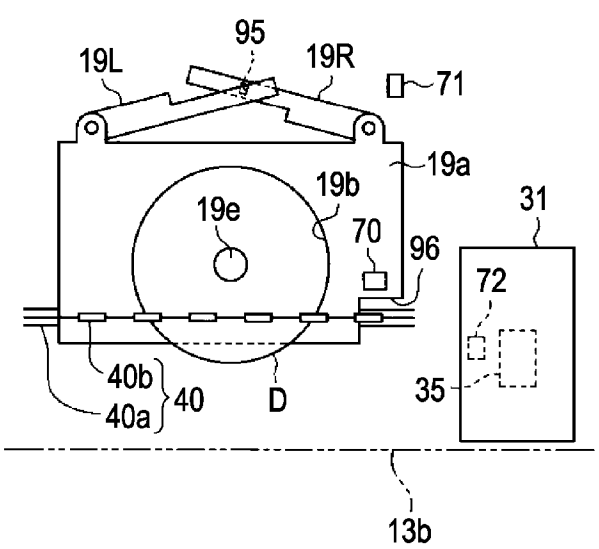

FIG. 5 is a schematic plane view showing the movement operation of the tray. FIG. 5A shows the accommodation position, FIG. 5B shows the set position, and FIG. 5C shows the printing standby position. As shown in FIG. 5A, in the case where the tray 19 is located at the accommodation position, the tray 19 moves to the upstream side of the pair of transport rollers 40. In the case where the tray 19 is located at the accommodation position, it is possible to perform the printing process on the paper sheet P since the pair of transport rollers 40 does not interfere with the transported paper sheet P and the tray 19.

In the case where the tray 19 is located at the accommodation position, the tray accommodation detector 71 becomes an on state since the tray accommodation detector 71 comes into contact with the tray 19. The position detector 70 becomes an off state since the position detector 70 faces the notch portion 96 (see FIG. 4) of the tray 19. In addition, the paper sheet width sensor 72 becomes an off state since there is nothing on the platen 36. Further, when the tray 19 moves to the accommodation position, the movement of the tray 19 is permitted after the existence of the disk D on the tray 19 is checked by the paper sheet width sensor 72. Accordingly, the disk D does not exist on the tray 19 located at the accommodation position.

In the printing standby position shown in FIG. 5C, the tray accommodation detector 71 becomes an off state since the tray accommodation detector 71 is away from the tray 19. In addition, the position detector 70 becomes an on state since the position detector 70 faces the tray 19. Further, the paper sheet width sensor 72 becomes an on state since the paper sheet width sensor 72 faces the disk D having high reflectivity.

In the case where the disk D is set on the tray 19 or the disk D having been subjected to the printing process is drawn out from the tray 19, the tray 19 is located at the set position shown in FIG. 5B so that the tray 19 is fully drawn out to the front side of the printer. When the tray 19 is located at the set position, the left and right guide arms 19L and 19R are nipped by the pair of transport rollers 40. In addition, in the entire movement path of the tray 19, the guide pins 92L and 92R respectively engage with the guide rails 90L and 90R, and the posture of the guide arms 19L and 19R continuously changed from the folded state shown in FIGS. 4 and 5A to the extended state shown in FIG. 5B.

In the case where the tray 19 is located at the set position shown in FIG. 5B, the tray accommodation detector 71 becomes an off state since the tray accommodation detector 71 is away from the tray 19. The position detector 70 becomes an off state since the position detector 70 faces the detection target hole 95 of the right guide arm 19R. The paper sheet width sensor 72 becomes an off state since the paper sheet width sensor 72 faces the tray 19 having low reflectivity. In addition, when the tray 19 first moves from the accommodation position to the set position in a power-on state, the detection target of the position detector 70 is changed from the notch portion 96 to the tray 19. Accordingly, the position of the tray 19 at the time when the position detector 70 is changed from on off state to an on state is set to the reference position, and the position of the tray 19 is recognized as a position (count value) relative to the reference position.

Power Transmission Switching Device

Figure 6:
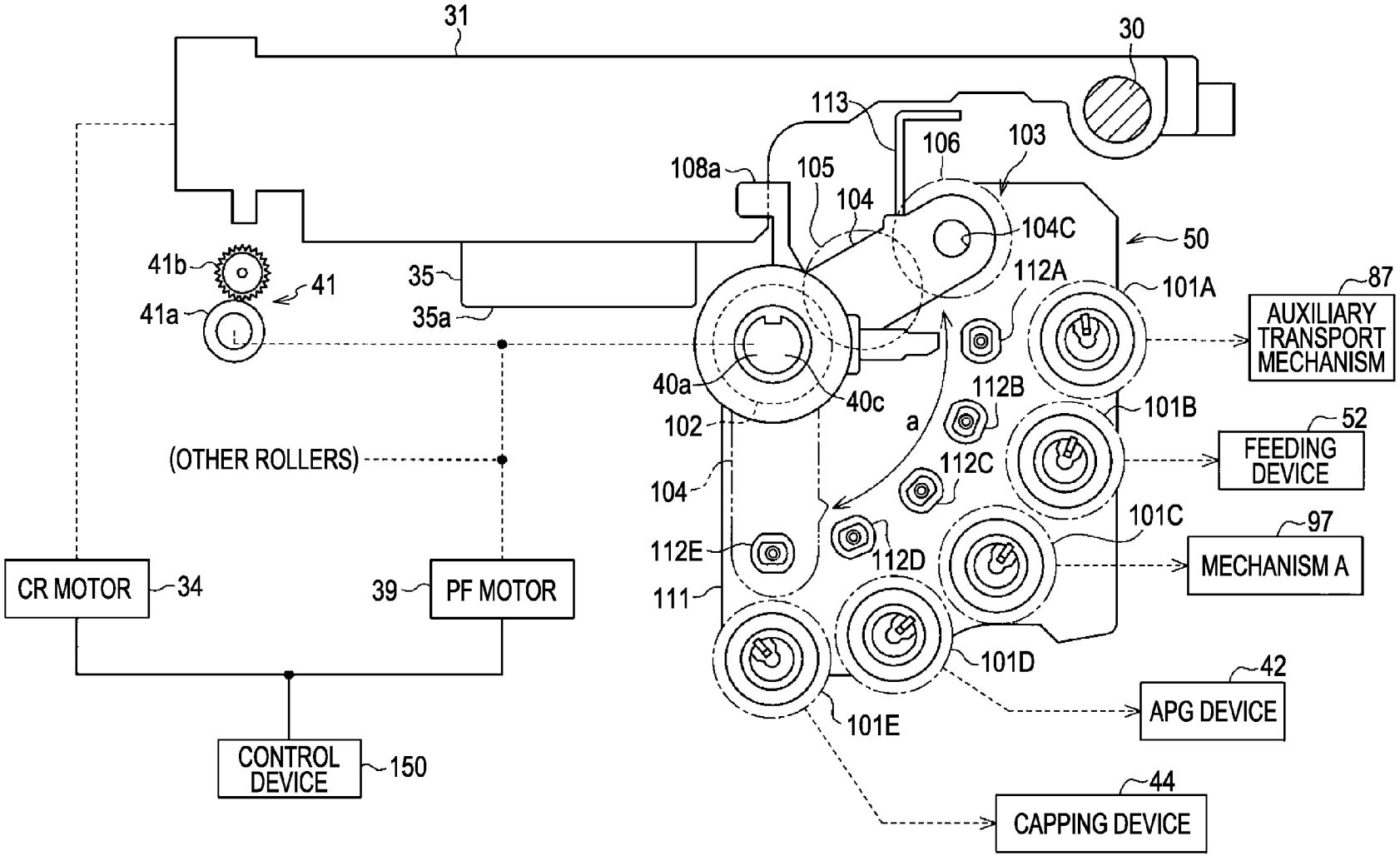
FIG. 6 is a schematic side view showing a power transmission switching device.

Next, the configuration of the power transmission switching device 50 will be described. First, the schematic configuration of the power transmission switching device 50 will be described with reference to FIG. 6. As shown in FIG. 6, the printer 11 includes the PF motor 39 and the CR motor 34 as the power source, and the two motors are controlled by the control device 150. The PF motor 39 is used as the common power source for the driving rollers 40*a*, 41*a*, 54, 62, 63, and 66, and changes the power transmission position via the power transmission switching device 50 so as to drive various driven parts, requiring the power, such as the feeding device 52, the APG device 42, the capping device 44, the auxiliary transport mechanism 87, and the mechanism A 97 in the printer 11. Here, the driving rollers 40*a*, 41*a*, 54, 62, 63, and 66 provided in the paper sheet transport path are connected one-to-one to the PF motor 39 without using the power transmission switching device 50, and are rotated when the PF motor 39 is rotationally driven. In addition, the mechanism A 97 in FIG. 6 shows, for example, a driven portion of an ink supply pump which supplies ink of the ink cartridges 28 to the printing head 35 in a pressurized state. The ink supply pump is provided inside the cartridge holder connected to the ink cartridges 28 or is provided in the course of the ink supply passageway between the cartridge holder and the printing head 35. In the embodiment, the number of power transmission positions of the power transmission switching device 50 is five, but may be, for example, six or more if the number is plural.

As shown in FIG. 6, a driving gear 102 is incorporated into the transport driving roller 40*a* so as to rotate together. The power transmission switching device 50 includes a power transmission portion 103 which is rotated to select one of input gears 101A, 101B, 101C, 101D, and 101E upon receiving rotary torque from the driving gear 102 of the transport driving roller 40*a* used as the power shaft (power input shaft) and which transmits the rotary torque to the one selected input gear. The input gears 101A, 101B, 101C, 101D, and 101E show the input gears of the auxiliary transport mechanism 87, the feeding device 52, the mechanism A 97, the APG device 42, and the capping device 44. As shown in FIG. 6, the five input gears 101A, 101B, 101C, 101D, and 101E are respectively arranged at positions equally away from the transport driving roller 40*a*, and are arranged in a row at the same interval therebetween so as to form a circular-arc shape in a plane perpendicular to the axis of the transport driving roller 40*a*.

The power transmission portion 103 includes an arm member 104 which is rotatably attached to the end portion of the roller driving shaft 40*c*, a first planetary gear 105 which is rotatably supported to the arm member 104 at a position meshing with the driving gear 102, and a second planetary gear 106 which is rotatably supported to the first planetary gear 105 so as to mesh therewith. The arm member 104 is relatively rotatable about the roller driving shaft 40*c* as a rotary shaft, and is attached to the roller driving shaft 40*c* so as to be movable in a thrust direction of the roller driving shaft 40*c*. When the carriage 31 moves in the forward direction as seen in FIG. 6 and pushes a carriage engagement portion 108*a* in the same forward direction, the power transmission portion 103 moves from a first position to a second position along the roller driving shaft 40*c* in the thrust direction. Then, the meshed state between the second planetary gear 106 and the input gear 101A, 101B, 101C, 101D, or 101E is released, and the power transmission portion 103 engages with the roller driving shaft 40*c* so as to be rotatable together. In addition, when the roller driving shaft 40*c* rotates by a predetermined rotation amount, the arm member 104 rotates to thereby select one input gear capable of meshing with the second planetary gear 106. Subsequently, when the carriage 31 retreats in a backward direction of FIG. 6, the power transmission portion 103 returns to the first position by urging force, and the second planetary gear 106 meshes with one selected input gear. For example, when rotary torque is transmitted in the state where the second planetary gear 106 meshes with the input gear 101A, the auxiliary transport mechanism 87 is driven.

Figure 7:
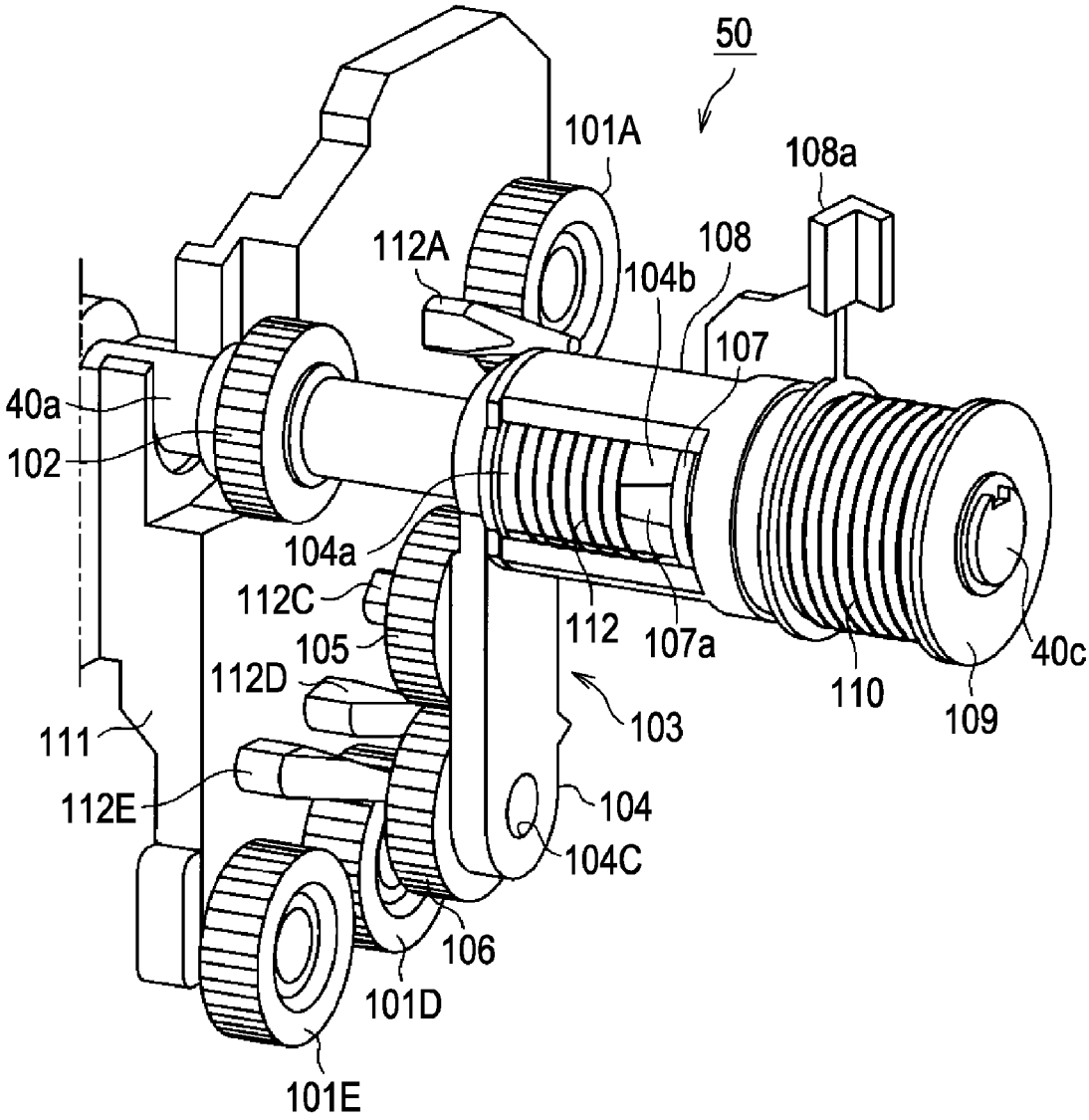
FIG. 7 is a perspective view showing the power transmission switching device.

Next, the detailed configuration of the power transmission switching device 50 will be described with reference to FIGS. 6 and 7. FIG. 7 is a perspective view showing the power transmission switching device 50. In addition, FIG. 7 shows the state where the power transmission portion 103 is located at the second position in which the meshed state between the input gear and the power transmission portion 103 is released. The power transmission portion 103 shown in FIGS. 6 and 7 is provided so as to be displaceable between the first and second positions which are located in the axial direction of the roller driving shaft 40*c*.

The arm member 104 includes a sleeve portion 104*a* having a shaft hole for allowing the roller driving shaft 40*c* to be inserted therethrough. The arm member 104 is slidable in the axial direction of the roller driving shaft 40*c* via the sleeve portion 104*a*, and is swingable about the roller driving shaft 40*c* as a swing shaft in a direction depicted by the arrow a shown in FIG. 6. As shown in FIG. 7, the end portion of the sleeve portion 104*a* of the arm member 104 is provided with a first engagement gear portion 104*b* having plural protrusion teeth protruding in the thrust direction and arranged in a circumferential direction.

Further, as shown in FIG. 7, a cylindrical member 107 is fixed to a position facing the first engagement gear portion 104*b* so as to rotate together with the roller driving shaft 40*c*. A second engagement gear portion 107*a* having plural protrusion teeth capable of meshing with the first engagement gear portion 104*b* is provided in the cylindrical member 107 so as to be located at a position facing the first engagement gear portion 104*b*.

As shown in FIG. 7, a cylindrical casing member 108 is provided so as to accommodate the first engagement gear portion 104*b* and the second engagement gear portion 107*a* therein. The sleeve portion 104*a* is allowed to be inserted into the casing member 108 via the opening provided on one side of the casing member 108. In the casing member 108, the roller driving shaft 40*c* and the arm member 104 are rotatable relative to the casing member 108. Even when the arm member 104 rotates, the casing member 108 maintains the posture in which the carriage engagement portion 108*a* protrudes upward.

As shown in FIG. 7, the shaft end portion of the roller driving shaft 40*c* is provided with a stopper 109. By means of urging force of a first coil spring 110 interposed between the stopper 109 and the casing member 108, the arm member 104 is urged in a direction toward a frame member 111 (the left direction of FIG. 7). Since the arm member 104 comes into contact with a regulation portion (not shown) of the frame member 111 due to the urging force, the first position is maintained.

Further, a second coil spring 112 is provided between the first engagement gear portion 104*b* and the left inner end surface of the casing member 108 shown in FIG. 7. When the carriage 31 pushes the carriage engagement portion 108*a* in the right direction of FIG. 7 so that the casing member 108 displaces in the right direction of FIG. 7 against the urging force of the first coil spring 110, the first engagement gear portion 104*b* is pushed in the right direction of FIG. 7 via the second coil spring 112, and the arm member 104 displaces in the right direction. As a result, the meshed state between the input gear and the second planetary gear 106 supported to the swing front end of the arm member 104 is released. Then, when the power transmission portion 103 moves to the second position, as shown in FIG. 7, the first engagement gear portion 104*b* meshes with the second engagement gear portion 107*a*.

At this time, even when both engagement gear portions 104*b* and 107*a* do not normally mesh with each other, but the front end portions of both gears collides with each other, elastic force of the second coil spring 112 is used as a cushion, thereby preventing occurrence of breakage or the like. In addition, when the transport driving roller 40*a* rotates by a predetermined amount in the state where the front end portions of both gears collide with each other, as shown in FIG. 7, both engagement gear portions 104*b* and 107*a* normally mesh with each other. Further, when the PF motor 39 is rotationally driven by a predetermined rotation amount in a predetermined direction in the state where the power transmission portion 103 is located at the second position so that both engagement gear portions 104*b* and 107*a* mesh with each other as shown in FIG. 7, the arm member 104 rotates together with the roller driving shaft 40*c* so as to select to the next connection position where the second planetary gear 106 is capable of meshing with one of the input gears 101A, 101B, 101C, 101D, and 101E.

In addition, when the carriage 31 moves away from the carriage engagement portion 108*a* in the second position shown in FIG. 7, the power transmission portion 103 moves to the first position by the urging force of the first coil spring 110. Also, the meshed state between the first engagement gear portion 104*b* and the second engagement gear portion 107*a* is released, and the second planetary gear 106 meshes with one selected input gear.

Further, in the frame member 111, positioning pins 112A, 112B, 112C, 112D, and 112E are respectively provided in the vicinity of positions corresponding to the input gears 101A, 101B, 101C, 101D, and 101E so as to protrude therefrom in the vertical direction. For example, when the positioning pin 112E is inserted into the hole 104C provided in the front end portion of the arm member 104 in the state where the second planetary gear 106 provided in the arm member 104 meshes with the input gear 101E, the swinging action of the arm member 104 is restrained, and the meshed state between the second planetary gear 106 and the input gear 101E is maintained.

Likewise, in the state where the power transmission portion 103 is located at the first position, the first planetary gear 105 meshes with the driving gear 102, and the rotary torque is transmitted in a sequential order of the driving gear 102, the first planetary gear 105, the second planetary gear 106, and one input gear selected from the input gears 101A, 101B, 101C, 101D, and 101E to thereby drive at least one of driven parts. In addition, as shown in FIG. 6, a positioning frame 113 is provided so as to come into contact with the arm member 104 when the arm member 104 rotates to the end in the counter-clockwise direction in FIG. 6. The rotation position of the arm member 104 is managed on the basis of an original point corresponding to the position where the arm member 104 comes into contact with the positioning frame 113.

Further, the power transmission portion 103 may be disposed between the first position and the second position. An intermediate position is set between the first position and the second position of the power transmission portion 103. In addition, by means of a holding member (not shown), the power transmission portion 103 is capable of being located at the intermediate position against the urging force of the first coil spring 110 irrespective of the position of the carriage 31.

APG Device

Figure 8:
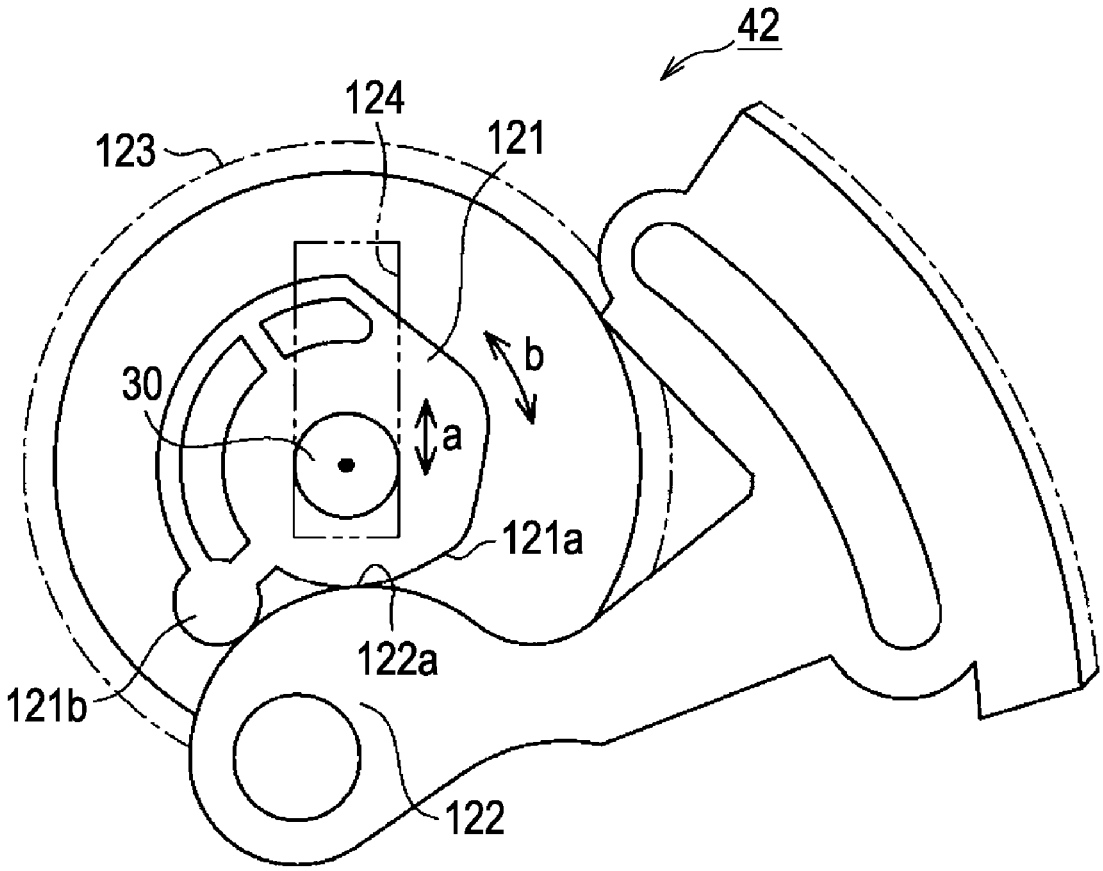
FIG. 8 is a side view showing an APG device.

Next, the configuration of the APG device 42 will be described. FIG. 8 is a side view showing the APG device. The APG device 42 is a device which adjusts the gap PG between the printing head 35 and the platen 36. As shown in FIG. 8, the APG device 42 includes a PG switching cam 121 which is attached to the axial end of the guide shaft 30 for the carriage, a regulation member 122 which engages with the PG switching cam 121, and a gear 123 which is attached to the axial end of the guide shaft 30.

In the PG switching cam 121, a peripheral cam surface 121*a* is formed such that a distance from the axis of the guide shaft 30 is different in the circumferential direction. The cam surface 121*a* is supported by a regulation surface 122*a* of the regulation member 122.

The axial end of the guide shaft 30 is loosely inserted into an elongate groove 124 which extends in a PG adjusting direction (the vertical direction of FIG. 8: the direction depicted by the arrow a). When the guide shaft 30 rotates, the PG switching cam 121 rotates relative to the regulation member 122 (in the direction depicted by the arrow b in the same drawing) so that the guide shaft 30 displaces in the PG adjusting direction. In addition, the gear 123 is a gear which obtains power from the input gear 101D of the power transmission switching device 50.

The APG device 42 with such a configuration is configured to stepwisely change the gap PG in four stages in a sequential order of a small gap to a large gap. Here, the PG switching cam 121 is provided with a stopper portion 121*b*. When the stopper portion 121*b* comes into contact with the regulation member 122, the rotation of the PG switching cam 121 stops.

Accordingly, upon changing the gap PG, the PG switching cam 121 first rotates in the counter-clockwise direction of FIG. 8 until the rotation of the PG switching cam 121 stops due to an action of the stopper portion 121*b* coming into contact with the regulation member 122. Then, when the PG switching cam 121 rotates by a predetermined rotation amount in the clockwise direction of FIG. 8 in this state (a state where a driving current value of the PF motor 39 exceeds a threshold value), the desired gap PG is set.

Figure 9A:
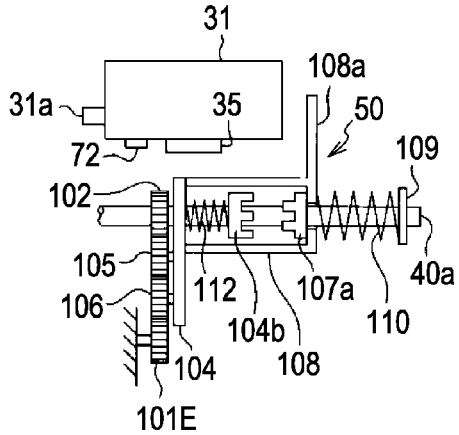
FIGS. 9A, 9B, and 9C are schematic front views illustrating operations of an APG reset process and an EJ frame reset process.
Figure 9B:
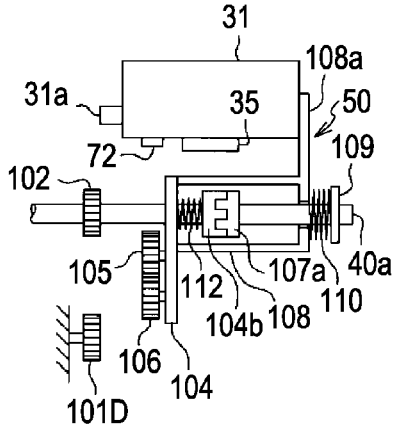
Figure 9C:
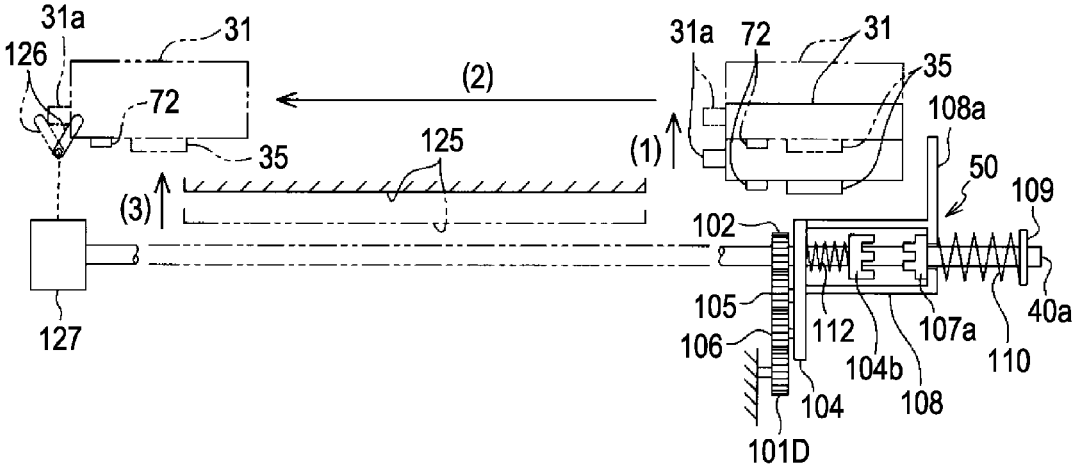

Next, the operation of the initialization process will be described with reference to FIGS. 9A, 9B, and 9C. In the initial process of a power-on process, there are initial items such as a home seek process, a PF reset operation, an APG reset operation, a paper sheet discharge frame reset operation (EJ frame reset operation), and a capping operation. FIGS. 9A, 9B, and 9C are schematic front view illustrating the APG reset operation and the paper sheet discharge frame reset operation corresponding to the initial items, where the operations cause the switching operation of the power transmission switching device 50.

When the carriage 31 located at the home position shown in FIG. 9A moves away from the carriage engagement portion 108*a* so that the arm member 104 is located at the first position, the second planetary gear 106 meshes with, for example, the input gear 101E. At this time, the first engagement gear portion 104*b* does not mesh with the second engagement gear portion 107*a*.

When the carriage 31 moves further from the home position to the switching selection position shown in FIG. 9B on the one digit side, the carriage 31 pushes the carriage engagement portion 108*a* so that the arm member 104 moves to the second position. As a result, the meshed state between the second planetary gear 106 and the input gear 101E is released, and the first engagement gear portion 104*b* meshes with the second engagement gear portion 107*a*. Then, when the PF metro 39 is rotationally driven in this state so that the transport driving roller 40*a* rotates, the arm member 104 rotates by meshing both engagement gear portions 104*b* and 107*a* with each other so as to select the next connection position where the second planetary gear 106 is capable of meshing with the input gear 101D of the APG device 42. Then, when the carriage 31 moves from the switching selection position to the home position, as shown in FIG. 9C, the second planetary gear 106 meshes with the input gear 101D of the APG device 42.

When the PF motor 39 is rotationally driven in this state, the rotary torque of the transport driving roller 40*a* is transmitted to the input gear 101D via the power transmission switching device 50. Then, when the PG switching cam 121 of the APG device 42 rotates so that the guide shaft 30 maximally ascends along the elongate groove 124, the carriage 31 is located at the maximum ascending position where the gap PG is a maximum value, and the APG device 42 is reset.

Likewise, after the carriage 31 is located at the maximum ascending position depicted by the two-dot dashed line in FIG. 9C, when the carriage 31 slightly moves to the one digit side by driving the CR motor 34 in the reverse direction, the carriage engagement portion 108*a* is pushed by a half degree. Accordingly, the arm member 104 is located at the intermediate position, and the power transmission from the APG device 42 is interrupted. Next, when the CR motor 34 is driven in the normal direction, the carriage 31 moves to the opposite home position. A lever 126 is provided at the opposite home position so as to be manipulated by an engagement portion 31*a* protruding from the side surface of the carriage 31, and the lever 126 is rotationally manipulated by the carriage 31 moving to the opposite home position. In the embodiment, an elevatable EJ frame 125 is provided in the vicinity of a discharge opening of the printer unit 13. When the printing process is performed on the paper sheet P, the EJ frame 125 descends so that a height-direction gap of the discharge opening is equal to a narrow gap in accordance with the thickness of the paper sheet P. On the other hand, when the printing process is performed on the label, the EJ frame 125 ascends so that the height-direction gap of the discharge opening is equal to a wide gap in accordance with the thickness of the disk D. When the lever 126 is located at a position depicted by the solid line in FIG. 9C, an elevation mechanism 127 of the EJ frame 125 is disconnected from the transport driving roller 40*a* so as to disable the power transmission therebetween. When the lever 126 is located at a position depicted by the two-dot dashed line in FIG. 9C, the elevation mechanism 127 is connected to the transport driving roller 40*a* so as to enable the power transmission therebetween. For this reason, when the PF motor 39 is rotationally driven in the state where the lever 126 is manipulated by the carriage 31 to be located at a position depicted by the two-dot dashed line, the EJ frame 125 moves from the descending position depicted by the two-dot dashed line in FIG. 5C to the maximum ascending position depicted by the solid line. Then, when the EJ frame 125 arrives at the maximum ascending position depicted by the solid line in FIG. 5C, the EJ frame 125 is reset.

Further, in the reset operation, in addition to the reset operation at the original point position, a reciprocation operation is performed so as to check whether the movement in the entire movement range is possible. For example, after the EJ frame 125 is reset to the original point, the EJ frame 125 reciprocates between the maximum ascending position and the maximum descending position so as to check whether an alien material corresponding to an obstacle of the movement exists in the course of the movement path. In addition, after the APG device 42 is reset to the original point, the carriage 31 reciprocates between the maximum ascending position and the maximum descending position so as to check whether an alien material corresponding to an obstacle of the movement exists in the course of the movement path. In this way, the APG reset operation and the EJ frame reset operation are performed. In addition, in the embodiment, the EJ frame 125 and the elevation mechanism 127 corresponding to the movable members constitute a discharge opening adjusting section.

In addition, the PF reset operation is a process performed to guarantee that an alien material (for example, a jammed paper sheet or the like) corresponding to an obstacle of the transport does not exist in the transport path. In the PF reset operation, an operation is performed which rotationally drive the pair of transport rollers 40 by a predetermined rotation amount in the paper sheet discharge direction in order to remove the paper sheet from the transport path even when the paper sheet exists in the transport path, and a process is performed which checks the non-detected state of the position detector 70. In addition, the other initialization items such as the home seek process will be described later. Further, the electric process of the APG reset operation and the PF reset operation will be described later.

Figure 10:
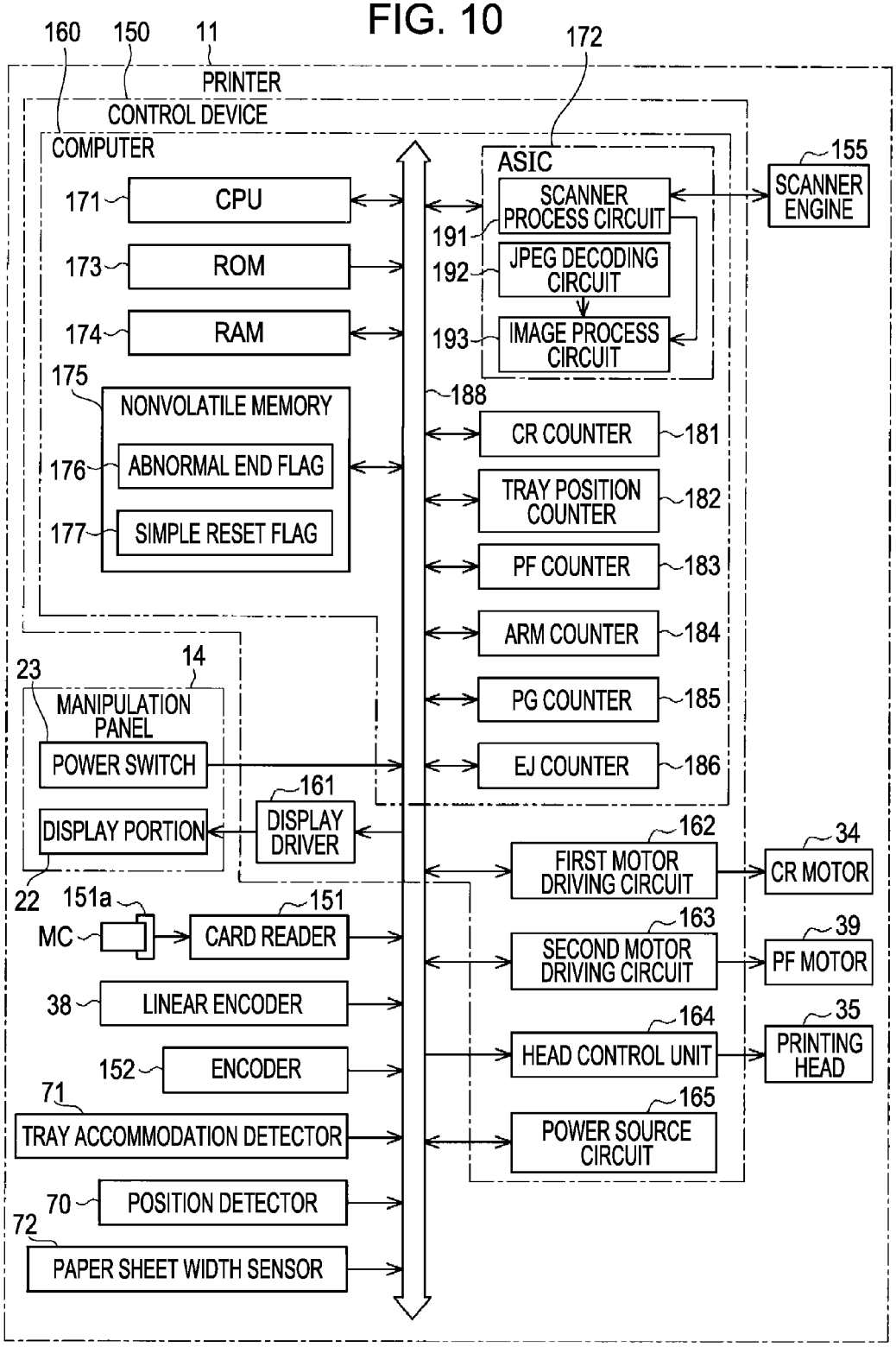
FIG. 10 is a block diagram showing an electric configuration of the printer.

Next, the electric configuration of the printer 11 will be described. FIG. 10 is a block diagram showing the electric configuration of the printer 11. As shown in FIG. 10, the printer 11 includes the control device 150. The control device 150 generally controls the printer 11.

The control device 150 is connected to an input system, that is, various switches including the power switch 23 constituting the manipulation panel 14, the display portion 22, a card reader 151, the linear encoder 38, an encoder 152, the tray accommodation detector 71, the position detector 70, and the paper sheet width sensor 72. In addition, the control device 150 is connected to an output system, that is, a scanner engine 155, the CR motor 34, the PF motor 39, and the printing head 35.

The control device 150 includes a computer 160 (micro computer), a display driver 161, a first motor driving circuit 162, a second motor driving circuit 163, a head control unit 164, and a power source circuit 165. The computer 160 performs a display control of the display portion 22 by using the display driver 161. In addition, the computer 160 controls the driving operation of the CR motor 34 by using the first motor driving circuit 162, and controls the driving operation of the PF motor 39 by using the second motor driving circuit 163. Further, the computer 160 controls the driving operation of the printing head 35 by using the head control unit 164 so as to perform an ejection control of an ink droplet.

Further, the computer 160 includes a CPU 171, an ASIC (Application Specific IC) 172, a ROM 173, a RAM 174, a nonvolatile memory 175, a CR counter 181, a tray position counter 182, a PF counter 183, an arm counter 184, a PG counter 185, and an EJ counter 186, which are connected to each other via a bus 188. The ASIC 172 includes a scanner process circuit 191, a JPEG decoding circuit 192, and an image process circuit 193. The nonvolatile memory 175 includes an abnormal end flag 176 and a simple reset flag 177. Further, a storage region of the abnormal end flag 176 is a first information storing region, and a storage region of the simple reset flag 177 is a second information storing region.

The ROM 173 stores a control program and the like which are executed by the CPU 171. The RAM 174 temporarily stores various data or the like used to execute a control program or a calculation result of the CPU 171 for the purpose of the process thereof. In addition, a part of the RAM 174 is used as a buffer which temporarily stores print data or image data before and after the process of the image process circuit 193 and the scanner process circuit 191 provided in the ASIC 172 or the CPU 171.

The scanner engine 155 optically reads the document placed on the document table glass 15, and outputs an electric charge accumulated in a CCD (charge coupled device) to the scanner process circuit 191 after performing an A/D conversion process on the electric charge using an A/D converting circuit. In the scanner process circuit 191, respective raster line data (multi-grayscale image data of RGB) input from the scanner engine 155 is accumulated in the buffer under the control of the CPU 171, and the RGB image data is sent to the image process circuit 193.

The JPEG decoding circuit 192 decompresses the image data of a JPEG format into, for example, multi-grayscale image data of RGB. For example, image data of a JPEG format captured by a digital camera is read from the memory card MC by the card reader 151 via an input terminal 151*a*, and is transmitted to the JPEG decoding circuit 192 provided in the ASIC 172. The JPEG decoding circuit 192 performs a decoding process on the image data of the JPEG format so that the image data is decoded into, for example, multi-grayscale image data of RGB, and the image data is transmitted to the image process circuit 193.

The image process circuit 193 performs a known image process such as a color change process, a halftone process, and a micro weave process on, for example, the image data of the RGB format transmitted from the scanner process circuit 191 or the JPEG decoding circuit 192, and transmits the image data having been subjected to the known image process to the RAM (buffer) 174. The CPU 171 creates head driving data (print data) on the basis of the image data stored in the buffer, and transmits the created head driving data to the head control unit 164. The head control unit 164 drives the printing head 35 on the basis of the head driving data, and controls the ejection of the ink droplet or the amount of the ejected ink droplet.

The linear encoder 38 includes a code plate of a black semitransparent tape shape which is provided along the movement path of the carriage 31 and in which a predetermined slit is provided in the longitudinal direction, and an optical sensor which is fixed to a predetermined position of the carriage 31 so as to detect the slit of the code plate (the code plate and the optical sensor are not shown). The optical sensor includes a pair of light emitting and receiving elements facing each other with the code plate interposed therebetween, and the light receiving element receives light emitted from the light emitting element and passing through the slit of the code plate. Accordingly, the linear encoder 38 outputs a pulse having the number of pulses proportional to the movement distance of the carriage 31 and a cycle inverse-proportional to the movement speed of the carriage 31. In the home seek process, when the carriage 31 moves to the one digit side and comes into contact with the end of the one digit side so that a driving current value of the CR motor 34 exceeds a predetermined threshold value, the CPU 171 resets the CR counter 181 and counts the number of pulses input from the linear encoder 38. In addition, the value of the CR counter 181 increases when the carriage 31 moves to the eighty digit side, and the value of the CR counter 181 decreases when the carriage 31 moves to the one digit side. The CPU 171 is configured to detect the position of the carriage 31 in the main scanning direction X on the basis of the count value of the CR counter 181.

In addition, the encoder 152 includes a rotary code disk which is fixed to the end portion of the shaft portion (for example, the shaft portion of the transport driving roller 40*a*) connected to the PF motor 39 so as to enable the power transmission therebetween, and a sensor which outputs two pulse signals having a phase difference of 90° therebetween in such a manner that a light receiving element receives light emitted from a light emitting element and passing through a predetermined slit formed in the code disk in the circumferential direction.

The tray position counter 182 is reset when the position detector 70 detects the front end portion corresponding to the notch portion 96 (see FIG. 4) of the tray 19. After the tray position counter 182 is reset, the tray counter 182 counts the number of pulse edges of the pulse signal input from the encoder 152. In addition, the value of the tray position counter 182 increases when the tray 19 moves to the downstream side in the transport direction, and the value of the tray position counter 182 decreases when the tray 19 moves to the upstream side in the transport direction. Accordingly, the CPU 171 is configured to detect the position of the tray 19 in the transport direction Y on the basis of the count value of the tray position counter 182.

The PF counter 183 is reset when the position detector 70 detects the front end portion of the paper sheet P, and is reset again when the front end portion of the paper sheet P arrives at the most upstream nozzle position (reference position) of the printing head 35. After the PF counter 183 is reset again, the PF counter 183 counts the number of pulse edges of the pulse signal input from the encoder 152. Accordingly, the CPU 171 is configured to detect the transport position of the paper sheet P, of which the reference position is set to the original point, on the basis of the count value of the PF counter 183.

The arm counter 184 is reset when the arm member 104 of the power transmission switching device 50 rotates in the counter-clockwise direction of FIG. 6 so as to come into contact with the positioning frame 113 and a driving current value of the PF motor 39 exceeds a predetermined threshold value. After the arm counter 184 is reset, the arm counter 184 counts the number of pulse edges of the pulse signal input from the encoder 152. Accordingly, the CPU 171 is configured to detect the position of the arm member 104 on the basis of the count value of the arm counter 184.

The PG counter 185 is reset when the carriage 31 arrives at the end of the maximum ascending position and the driving current value of the PF motor 39 exceeds the predetermined threshold value. After the PG counter 185 is reset, the PG counter 185 increases or decreases the number of pulse edges of the pulse signal input from the encoder 152 in accordance with the movement direction of the carriage 31. Accordingly, the CPU 171 is configured to detect the height-direction position (i.e., the gap PG) of the carriage 31 on the basis of the count value of the PG counter 185.

The EJ counter 186 is reset when the EJ frame 125 arrives at the end of the maximum ascending position and the driving current value of the PF motor 39 exceeds the predetermined threshold value. After the EJ counter 186 is reset, the EJ counter 186 increases or decreases the number of pulse edges of the pulse signal input from the encoder 152 in accordance with the movement direction of the EJ frame 125. Accordingly, the CPU 171 is configured to detect the height-direction position (i.e., the discharge opening width) of the EJ frame 125 on the basis of the count value of the EJ counter 186.

The abnormal end flag 176 becomes an on state when the power-off operation is abnormal. Here, the abnormal end flag 176 becomes an on state in the following cases: (1) a case where fatal error is generated when the power is not supplied, (2) a case where a plug is separated from a wall socket, and (3) a case where the power-off operation is not successfully performed. In these cases, since the power-off operation cannot be performed or the power-off operation is not normally performed, the abnormal end flag 176 becomes an on state.

For example, in the case where the fatal error is generated, since it is not possible to normally detect the position (i.e., the position or height of the carriage 31 in the main scanning direction, the height of the EJ frame 125, and the like) required for the power-off operation, it is not possible to perform the power-off operation. In addition, in the case where the plug is separated from the wall socket, since the power supply to the printer 11 stops, the process of writing the abnormal end flag 176 which can be performed in a short time using low electric power can be performed by, for example, accumulated electric power or the like, but the power-off operation cannot be performed. Further, the case where the power-off operation cannot be successfully performed indicates, for example, a case where the carriage 31 or the EJ frame 125 cannot move due to a certain problem or a case where the plug is separated from the wall socket during the power-off operation.

Here, the power-off operation is a mechanical operation including an operation of moving the tray 19, the carriage 31, the EJ frame 125, the cap 45, and the like to the respective predetermined end positions. In the case where the power-off operation normally ends, the tray 19 is located at the accommodation position, the carriage 31 is located at the groove position and the maximum ascending position (reset position), the EJ frame 125 is located at the maximum ascending position (reset position), and the cap 45 is located at the capping position (ascending position). In addition, the power-off operation will be described in detail later.

Figure 11:
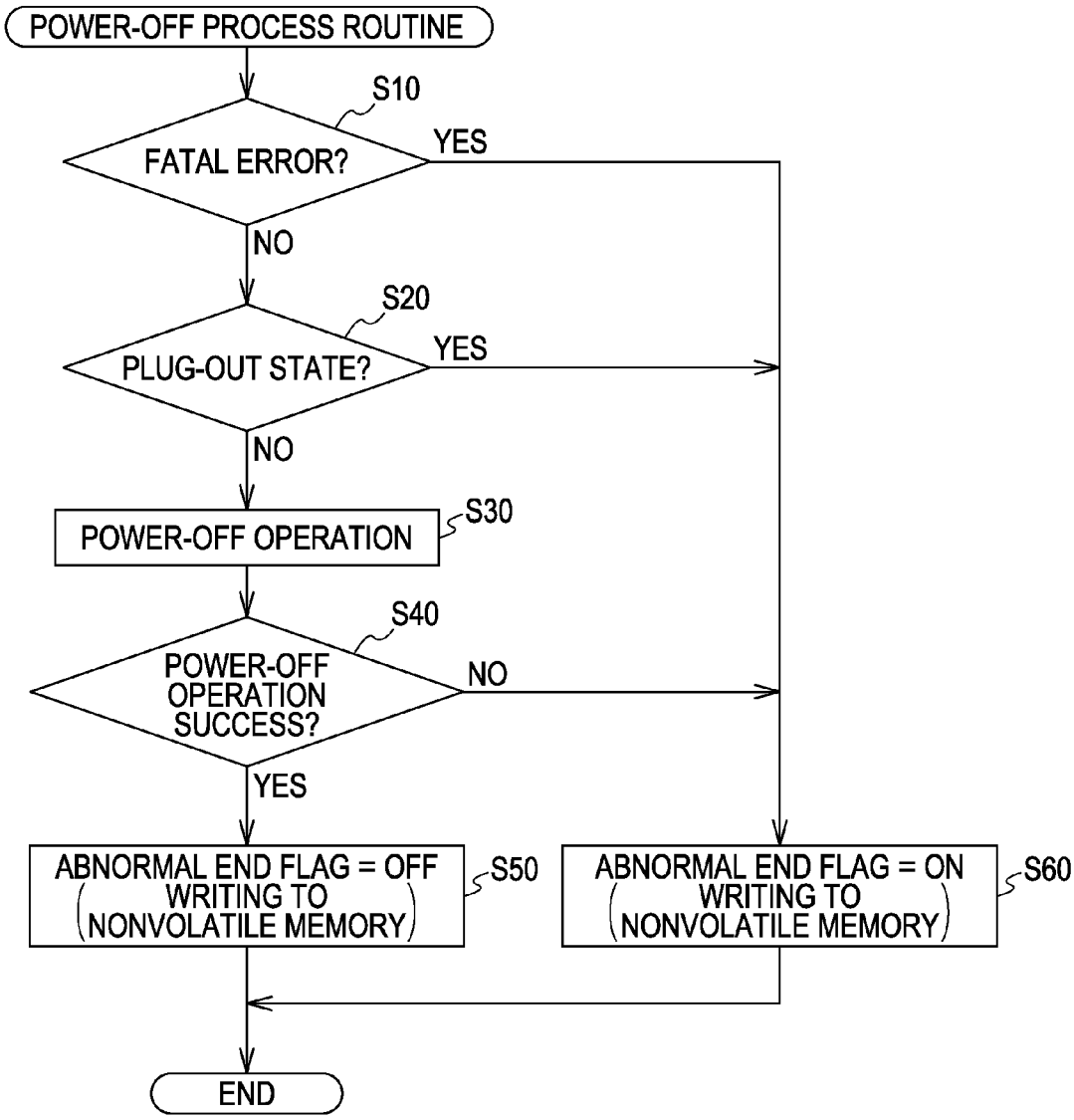
FIG. 11 is a flowchart showing a power-off process routine.
Figure 12:
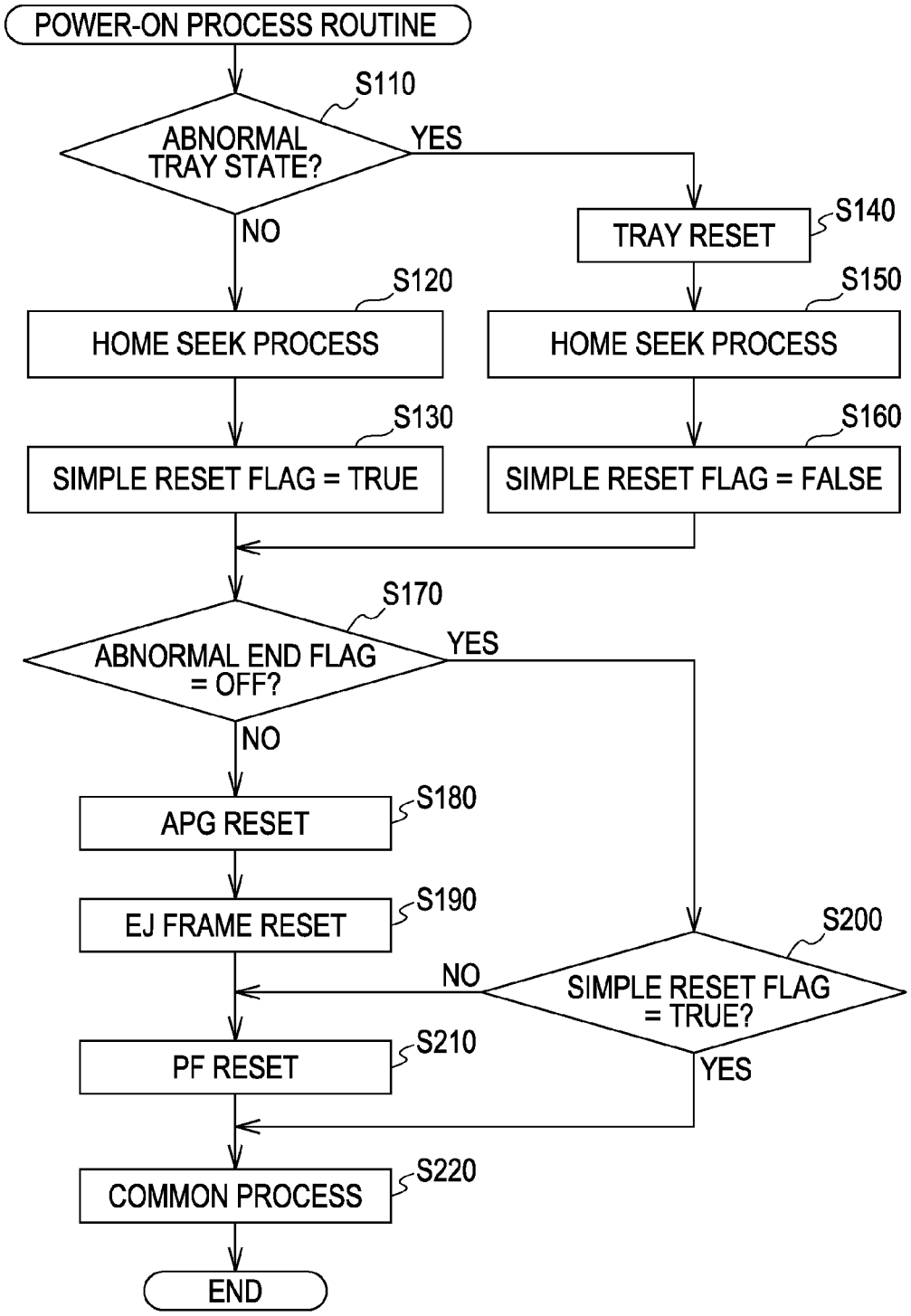
FIG. 12 is a flowchart showing a power-on process routine.

The nonvolatile memory 175 stores a power-off process routine program shown in the flowchart in FIG. 11 and a power-on process routine program shown in the flowchart in FIG. 12. The CPU 171 performs the power-off process routine shown in FIG. 11 when the power switch 23 is pushed in the activation state of the printer 11 (i.e., the power-off operation is performed) or the plug-out state is detected. In addition, the CPU 171 performs the power-on process routine shown in FIG. 12 when the power switch 23 is pushed during the stop state of the printer 11 (power-off state) (i.e., the power-on operation is performed). Here, the power-on process routine is a process of performing a mechanical initialization process of the printer 11 in a power-on state. The mechanical initialization process includes the home seek process, the APG reset, the EJ frame reset, the PF reset, and the like.

The home seek process is a process of guaranteeing that the carriage 31 returns to the original point in the main scanning direction X and the carriage 31 is movable in the entire movement path. In detail, the home seek process includes a reset operation of setting the original point of the carriage 31 in the main scanning direction by resetting the CR counter 181, and an operation of guaranteeing that the carriage 31 is movable in the entire movement path in the main scanning direction X without any problem in such a manner that the carriage 31 moves to the opposite home position (eighty digit side) by driving the CR motor 34.

For example, in the case where the tray 19 is not located at the accommodation position as the normal position in the power-off state, the tray 19 may be located at the movement path of the carriage 31 in the main scanning direction X, and the carriage 31 may interfere with the tray 19 during the home seek process. In addition, since it is not possible to guarantee that the carriage 31 is located at the maximum ascending position in the case of the abnormal end, only the reset operation is performed during the home seek process in the power-on state after the abnormal end.

The APG reset is a process of guaranteeing that the carriage 31 returns to the original point in the height direction and the carriage 31 is movable in the entire movement path in the height direction. In detail, first, the power transmission switching device 50 moves to the switching position of selecting the APG device 42, and the PF motor 39 is driven so that the carriage 31 ascends, thereby performing the reset operation of resetting the PG counter 185. Next, the PF motor 39 is driven in the reverse direction so that the carriage 31 descends to the descending-side end on the basis of the count value of the PG counter 185, and the PF motor 39 is driven in the normal direction so that the carriage 31 returns to the maximum ascending position, thereby checking whether the carriage 31 is elevatable in the entire movement path in the height direction without any problem.

In addition, the EJ reset is a process of guaranteeing that the EJ frame 125 returns to the original point in the height direction and the EJ frame 125 is movable in the entire elevation path. In detail, when the carriage engagement portion 108*a* is pushed by a half degree by the carriage 31 by driving the CR motor 34 in the reverse direction in the state where the carriage 31 is located at the maximum ascending position as shown in FIG. 9C, the power transmission switching device 50 is switched to be located at the intermediate position as described above. Subsequently, the lever 126 is manipulated by the carriage 31 by driving the CR motor 34 in the normal direction. When the EJ frame 125 ascends by driving the PF motor 39 in this state, the EJ counter 186 is reset. In addition, the EJ frame 125 descends to the descending-side end by driving the PF motor 39 in the reverse direction so as to check whether the EJ frame 125 is movable in the entire elevation path without any problem.

Next, the power-on process and the power-off process performed by the CPU 171 in the printer 11 with such a configuration will be described with reference to the flowcharts in FIGS. 11 and 12.

A task of monitoring the power-off state is performed by the CPU 171 in the activation state of the printer 11. When the power-off state is detected by the task, the CPU 171 performs the power-off process routine shown in FIG. 11. In addition, the power-off state is detected by the task in the case where the power switch 23 is pushed in the activation state of the printer 11 or the plug is separated from the wall socket.

First, in Step S10, it is determined whether the fatal error is generated. When the fatal error is generated, the current step moves to Step S60, and the abnormal end flag becomes an on state. That is, "1" is written in the abnormal end flag 176 of the nonvolatile memory 175. On the other hand, when the fatal error is not generated, in Step S20, it is determined whether the plug is separated from the wall socket. When the plug-out state is detected, the current step moves to Step S60, and the abnormal end flag becomes an on state. On the other hand, when the plug-out state is not detected, in Step S30, the power-off operation is performed. That is, if the fatal error is not generated when the user pushes the power switch 23, the power-off operation is performed.

In the power-off operation, when the disk D does not exist on the tray 19, the power is turned off in the state where the tray 19 is located at the accommodation position. At this time, the carriage 31 moves in the main scanning direction X so as to pass through the upper space of the tray 19 in the state where the tray 19 is located at the printing standby position, and the reflected light is detected by the paper sheet width sensor 72, thereby determining the existence of the disk D on the basis of the degree of the reflectivity. For example, when a detection voltage proportional to the degree of the reflected light received by the paper sheet width sensor 72 exceeds a threshold value (i.e., the reflectivity exceeds the threshold value thereof), it is determined that the disk D exists. When the disk D does not exist, the tray 19 moves to the accommodation position, and the power is turned off.

On the other hand, in the case where the disk D does not exist, the tray 19 moves to the set position and the user is prompted to extract the disk D from the tray in such a manner that a text or illustration for prompting an operation of separating the disk from the tray is displayed on the display portion 22. In addition, when the user pushes the power switch 23 again, the existence of the disk is determined again by moving the tray 19 to the printing standby position. When the disk D does not exist, the tray 19 moves to the accommodation position, and the power is turned off. On the other hand, when the disk D exists on the tray 19 again, the tray 19 moves again to the set position, and the user is prompted to extract the disk D from the tray. However, in the case where the disk D exists on the tray 19 even when the power switch 23 is pushed a predetermined number of times or in the case where a predetermined time is elapsed without any action performed by the user after the tray 19 moves to the set position due to the existence of the disk D on the tray 19, the power may be turned off in the state where the tray 19 is located at the printing standby position. In this case, the information that the disk D exists on the tray 19 and the tray 19 is located at the printing standby position is written in the nonvolatile memory 175.

Further, in the case where the printing process is performed on the paper sheet before the power is turned off, when it is determined that the carriage 31 and the EJ frame 125 are respectively located at the positions lower than the maximum ascending positions on the basis of the count values of the PG counter 185 and the EJ counter 186, an operation in which the carriage 31 and the EJ frame 125 respectively ascend to the maximum ascending positions (reset positions) is performed. In addition, in the case where the carriage 31 is located at a position except for the home position or the carriage 31 moves from the home position to turn off the printer 11 (for example, the case where the switching operation of the power transmission switching device 50 is performed or the existence of the disk is determined), an operation in which the carriage 31 moves to the home position and the cap 45 ascends to cap the printing head 35 is performed. Further, in order to guarantee that the paper sheet does not exist on the paper sheet transport path, an operation in which the pair of transport rollers 40 and the pair of discharge rollers 41 rotate by a predetermined rotation amount in the paper sheet discharge direction is performed, and it is checked whether the position detector 70 is in a non-detection state (off state).

Then, in Step S40, it is determined whether the power-off operation is successfully performed. When the power-off operation is successfully performed, in Step S50, the abnormal end flag becomes an off state. That is, "0" is written in the abnormal end flag 176 of the nonvolatile memory 175. On the other hand, when the power-off operation is not successfully performed, in Step S60, the abnormal end flag becomes an on state. That is, "1" is written in the abnormal end flag 176 of the nonvolatile memory 175. Here, in the case where the power-off operation is successfully performed, the carriage 31 is located at the maximum ascending position, and the EJ frame 125 is located at the maximum ascending position. In addition, in the embodiment, the CPU 171 performing the processes in Step S10, Step S20, and Step S40 constitutes an abnormal detection section. Further, Step S10, Step S20, and Step S40 correspond to the step of detecting an abnormal state, and Step S50 and Step S60 correspond to the first storage step.

Next, the power-on process at the time when the user pushes the power switch 23 of the printer 11 in a stop state will be described. When the pushing signal of the power switch 23 is input, the CPU 171 performs the power-on process routine in FIG. 12. In addition, when the power is turned off in the state where the tray 19 is located at the printing standby position due to the existence of the disk D on the tray 19 during the power-off process, the flag informing the existence of the disk D becomes an on state, and the flag is stored in the nonvolatile memory 175. In the case where the flag is in an on state, the tray 19 moves to the set position, and the user is prompted to extract the disk D from the tray 19. In addition, when the power is turned off in the state where the tray 19 is located at the accommodation position, the power-on process routine in FIG. 12 is performed.

First, in Step S110, it is determined whether the tray is in an abnormal state. In the case of this example, the case where the tray 19 is located at the accommodation position is a normal state, and the case where the tray 19 is not located at the accommodation position is an abnormal state. That is, the normal state is determined when the tray accommodation detector 71 is in a detection state (ON), and the abnormal state is determined when the tray accommodation detector 71 is in a non-detection state (OFF). Here, the abnormal state is determined even in the case where the tray 19 deviates from the accommodation position due to an operation in which the printer 11 is moved or inclined by the user or a certain shock is applied to the printer 11.

In the case of the normal state in which the tray 19 is located at the accommodation position, in Step S120, the home seek process is performed. Then, in next Step S130, the simple reset flag is set to "TRUE". That is, "1" is written in the simple reset flag 177 of the nonvolatile memory 175. On the other hand, in the case of the abnormal state in which the tray 19 is not located at the accommodation portion, in Step S140, the tray reset operation is performed. That is, CPU 171 moves the tray 19 to the accommodation position by driving the PF motor 39. At this time, the CPU 171 monitors the detection state of the tray accommodation detector 71. When the detection signal is changed from the non-detection state (OFF) to the detection state (ON), the CPU 171 stops the driving operation of the PF motor 39.

Then, after the tray reset operation, in Step S150, the home seek process is performed. After the home seek process ends, in Step S160, the simple reset flag is set to "FALSE". That is, "0" is written in the simple reset flag 177 of the nonvolatile memory 175.

Here, in the home seek process, the CR motor 34 is driven so that the carriage 31 moves to the one digit side end. At this time, the CPU 171 monitors the driving current value of the CR motor 34. When the driving current value exceeds the threshold value, the CPU 171 determines that the carriage 31 comes into contact with the end, and resets the CR counter 181 at this carriage position. Additionally, the carriage 31 moves to the eighty digit side end. At this time, the CPU 171 monitors if the driving current value exceeds the threshold value at the carriage position before the count value of the end is obtained. That is, in the entire carriage movement path, the CPU 171 checks whether the carriage 31 is movable without any problem.

In next Step S170, it is determined whether the abnormal end flag is "OFF". That is, the CPU 171 reads the value of the abnormal end flag from the nonvolatile memory 175 and determines whether the value is "0" (OFF). When the abnormal end flag is not "OFF" (i.e., the abnormal flag is "ON"), it is determined that the power-off operation cannot be successfully performed due to the reasons of the fatal error, the plug-out state, and the power-off failure upon turning off the printer 11. In this case, there is a possibility that at least one of the carriage 31 and the EJ frame 125 is not located at the maximum ascending position, and it is not possible to guarantee that all the carriage 31 and the EJ frame 125 are located at the reset position (maximum ascending position). Accordingly, in the case where the abnormal end flag is not "OFF" (the abnormal flag is "ON"), the APG reset operation (Step S180) and the EJ frame reset operation (Step S190) are sequentially performed.

That is, in the APG reset operation in Step S180, the carriage 31 moves to the position shown in FIG. 9B so as to release the meshed state of the second planetary gear 106, and the PF motor 39 is driven so as to rotate the arm member 104, thereby selecting the switching position of the second planetary gear 106 at the position where the second planetary gear 106 is capable of meshing with the input gear 101D (see FIG. 6) of the APG device 42. Then, as shown in FIG. 9C, the carriage 31 moves away from the carriage engagement portion 108*a* so that the second planetary gear 106 meshes with the input gear 101D of the APG device 42. In addition, in this state, the APG device 42 is driven by driving the PF motor 39 in the normal direction so that the carriage 31 ascends to the maximum ascending position. At this time, the CPU 171 monitors the driving current value of the PF motor 39, and resets the PG counter 185 when the carriage 31 arrives at the ascending-side end and the driving current value exceeds the threshold value. When the PG counter 185 is reset in this way, the PF motor 39 is driven in the reverse direction and the normal direction. Then, on the basis of the value of the PG counter 185, it is checked whether the carriage 31 is movable in the entire elevation path without any problem, and the carriage 31 stops at the reset position (maximum ascending position). In addition, in the process (APG reset operation) in Step S180 corresponds to the reset process of the gap adjusting section.

In addition, in the EJ frame reset operation in Step S190, the CPU 171 drives the CR motor 34 so that the carriage 31 moves to the opposite home position as depicted by the arrow (2) in FIG. 9C and the lever 126 is manipulated by the carriage 31. Accordingly, the connection state of the elevation mechanism 127 is changed so as to enable the power transmission between the elevation mechanism 127 and the transport driving roller 40*a*. At this time, since the carriage 31 is located at the maximum ascending position, it is possible to manipulate the lever 126 when the carriage 31 moves to the opposite home position. In addition, when the carriage 31 pushes the carriage engagement portion 108*a* by a half degree and moves to the opposite home position, the meshed state between the second planetary gear 106 and the input gear is released, and the power transmission switching device 50 is maintained to be located at the intermediate position where the first engagement gear portion 104*b* does not mesh with the second engagement gear portion 107*a*.

In this state, the CPU 171 drives the PF motor 39 in the normal direction so that the EJ frame 125 ascends. At this time, the CPU 171 monitors the driving current value of the PF motor 39, and resets the EJ counter 186 when the EJ frame 125 arrives at the ascending-side end and the driving current value exceeds the threshold value. When the EJ counter 186 is reset in this way, the PF motor 39 is driven in the reverse direction and the normal direction. On the basis of the value of the EJ counter 186, it is checked whether the EJ frame 125 is movable in the entire elevation path without any problem, and the EJ frame 125 stops at the reset position (maximum ascending position). Then, the CR motor 34 is driven in the reverse direction so that the carriage 31 returns to the home position. Likewise, in the case of the abnormal end in which the power-off operation is not successfully performed upon turning off the printer 11, the APG reset operation and the EJ frame reset operation are performed. In addition, the process (EJ frame reset operation) in Step S190 corresponds to the reset operation of the discharge opening adjusting section.

On the other hand, when the abnormal end flag is "OFF", in Step S200, it is determined whether the simple reset flag is "TRUE". Then, when the simple reset flag is not "TRUE", the current step moves to Step S210, and the PF reset process is performed. That is, in the case where the power-off operation is successfully performed upon turning off the printer 11 even when the tray state is abnormal ("YES" in Step S110), since it is possible to guarantee that all the APG device 42 and the EJ frame 125 are respectively located at the reset positions, the APG reset operation and the EJ frame reset operation are omitted.

The PF reset operation is performed as below. The CPU 171 drives the PF motor 39 in the normal direction so as to sequentially rotate the transport driving roller 40*a* in the transport direction by a predetermined rotation amount capable of reliably discharging the paper sheet even when the paper sheet exists on the transport path, and checks whether the position detector 70 is in a non-detection state. Although it is not possible to reliably guarantee that an alien material (including the paper sheet) does not exist on the transport path just by receding the tray 19 to the accommodation position in this way, if the PF reset operation is performed, it is possible to further reliably guarantee that the alien material such as the paper sheet does not exist on the transport path.

On the other hand, in the case where the simple reset flag is "TRUE", the current step moves to Step S220, and the common process is performed. That is, in the case where the power-off operation is successfully performed upon turning off the printer 11, the simple initialization process is performed without performing the APG reset operation, the EJ frame reset operation, and the PF reset operation.

Here, the common process indicates a process of performing the initialization items which are commonly performed in the all initialization process and the simple initialization process. In the common process according to the embodiment, the insertion state check of the ink cartridges 28, the measurement process (parameter setting) of the CR motor 34, and the like are performed. Each ink cartridge 28 includes a terminal which is electrically connected to a cartridge-holder-side terminal for permitting an access of the CPU 171 of the printer 11 in the case where the ink cartridge 28 is inserted into the cartridge holder, and a CSIC (Customer Service IC). In order to read various ink information (a serial number, color information, an ink remaining amount (or an ink consumed amount), and the like) from the memory of the CSIC, the CPU 171 tries to access to the memory. If the access is successfully performed, it is determined that the ink cartridge 28 is an inserted state. Additionally, in the measurement process of the CR motor 34, the CR motor 34 is driven so as to measure a motor load caused by a sliding resistance during the movement of the carriage 31 at the set speed profile, and a motor driving parameter (for example, a PWM (Pulse Width Modulation) control duty ratio or the like) in accordance with the measured motor load is set in order to handle a variation in age of the sliding resistance.

Likewise, even when the tray 19 deviates from the accommodation position due to an operation in which the printer 11 is moved or inclined by the user upon turning off the printer 11, if the power-off operation is normally performed upon turning off the printer 11, a part of the process may be omitted without performing the all initialization process upon turning on the printer 11. For this reason, the printer 11 promptly becomes the printing activation state, and hence the printing process is promptly performed.

Further, in the embodiment, Step S110 corresponds to the step of detecting the tray position state, and Step S140 corresponds to the step of moving the tray. In addition, Step S130 and Step S160 correspond to the second storage step, and Step S120, Step S150, Step S180, Step S190, and Step S210 correspond to the step of performing the initialization process. In the embodiment, the CPU 171 performing the processes of Step S120, Step S150, Step S180, Step S190, Step S210, and Step S220 constitutes an initialization process performing section. Further, the respective processes of Step S120 (or Step S150), Step S180, Step S190, Step S210, and Step S220 correspond to the initialization items forming the first initialization process. The respective processes of Step S150, Step S210, and Step S220 correspond to the initialization items forming the second initialization process. The respective processes of Step S120 (Step S150) and Step S220 correspond to the initialization items forming the third initialization process. Regarding the common process of Step S220, the insertion state check of the ink cartridges 28 and the measurement process of the CR motor 34 forming the common process correspond to the initialization items. Further, the PF reset process in Step S210 corresponds to a part of the initialization items performed in the second initialization process among the initialization items omitted in the third initialization process.

As described above, according to the embodiment, the following advantages are obtained.

(1) In the case where the power-off operation is not normally performed during the power-off process, the abnormal end flag becomes an on state. In addition, in the case where the tray 19 is in the abnormal state during the power-on process, the home seek process is performed after moving the tray 19 to the accommodation position, and the simple reset flag is set to "FALSE". Further, in the case where the abnormal end flag is "OFF" and the simple reset flag is "FALSE", the APG reset operation and the EJ reset operation are omitted. Accordingly, although it is not the simple initialization process, it is possible to simply perform the initialization process compared with the all initialization process.

(2) Although it is possible to simply perform the initialization process compared with the all initialization process, the PF reset operation is performed. For this reason, it is possible to further reliably guarantee that the alien material such as the paper sheet does not exist on the paper sheet transport path.

(3) After the reset operation of moving the tray 19 to the accommodation position is performed, if the tray reset operation is successfully performed, it is possible to guarantee the APG reset state in which the carriage 31 is located at the maximum ascending position (reset position). That is, since the tray reset operation required for the initialization of the tray 19 is performed, it is possible to indirectly guarantee the APG reset state. Accordingly, in order to check the APG reset state, it is not necessary to perform an additional process.

(4) After performing the tray reset operation of moving the tray 19 to the accommodation position, if the tray reset operation is successfully performed, it is possible to guarantee the EJ frame reset state in which the EJ frame 125 is located at the maximum ascending position (reset position). That is, since the tray reset operation required for the initialization of the tray 19 is performed, it is possible to indirectly guarantee the EJ frame reset state. Accordingly, in order to check the EJ frame reset state, it is not necessary to perform an addition process.

(5) If the tray reset operation which is performed when the tray 19 is in the abnormal state is successfully performed, it is possible to indirectly guarantee plural types of reset states such as the APG reset state and the EJ frame reset state. Accordingly, if the tray reset operation is successfully performed, it is possible to omit plural types of initialization processes.

(6) In the case where the disk D exists on the tray 19 during the power-off operation, a configuration may be adopted which turns off the printer 11 by accommodating the tray at the standby position after a predetermined time without leaving the tray as it is. In this case, on the basis of the information (flag=ON) stored in the nonvolatile memory 175 during the power-off process, the user is prompted to extract the disk D from the tray 19 after moving the tray 19 to the set position in the power-on state. For this reason, it is possible to prevent the tray 19 from moving to the accommodation position or to prevent the home seek process from being performed even in the case of the existence of the disk D.

The above-described embodiment is not limited to the above description, but may be modified into various forms as below.

Modified Example 1

In the above-described embodiment, in the case where the first information is normal (the abnormal end flag=OFF) and the second information is normal (the simple reset flag=TRUE), the operation of a part of the initialization items is performed as the common process (S220). However, for example, in the case where the power-off process is successfully performed as in JP-A-2000-99214, a configuration may be adopted which skips the initialization process. That is, a configuration may be adopted which does not perform the third initialization process.

Modified Example 2

In the case where the first information is normal (the abnormal end flag=OFF) and the second information is abnormal (the simple reset flag=FALSE), the PF reset operation (S210) is performed, but the PF reset operation may be omitted. After the tray 19 moves to the accommodation position, when the position detector 70 is in the non-detection state, no problem arises even when it is determined that the alien material does not exist on the paper sheet transport path. Likewise, the initialization items of the second initialization process and the third initialization process may be the same as each other. Even in this case, when the tray position state is abnormal even after the power-off process is normally performed, the simple initialization process may be performed.

Modified Example 3

In the second initialization process, the PF reset operation is performed among the initialization items omitted in the simple initialization process (third initialization process). However, the initialization item which is not omitted in the second initialization process may be an operation except for the PF reset operation.

Modified Example 4

The initialization items which are omitted in the second initialization process are not limited to the APG reset (S180) and the EJ frame reset (S190). For example, any one of the two initialization items may be omitted, the initialization items except for the two initialization items may be omitted, or other initialization items may be omitted in addition to the two initialization items.

Modified Example 5

The tray normal position is not limited to the accommodation position. An appropriate position may be selected as the tray normal position as long as the selected position does not disturb the other initialization items. For example, the printing standby position may be selected as the tray normal position if the carriage is not disturbed.

Modified Example 6

In the above-described embodiment, the cases of the fatal error, the plug-out state, and the power-off failure are considered as the abnormal state in which the power-off operation is not normally performed. However, any one or two of them may be considered as the abnormal state. Further, other cases may be considered as the abnormal state.

Modified Example 7

The type of storing the first information and the second information is not limited to the flag. For example, the type may be data of two bits or more. Further, the second information storing section is not limited to the nonvolatile memory, but may be a RAM.

Modified Example 8

The invention may be applied to a label-printing-purpose printing apparatus which does not include a transporter for transporting a second printing medium such as a paper sheet.

Modified Example 9

In the above-described embodiment, the tray is used to place a printing medium (first rigid printing medium) as the disk D thereon, but may be used to set a printing medium (second soft printing medium) as the paper sheet thereon. In addition, the printing medium to be set on the tray may be a resinous film, a metallic film, a cloth, a film substrate, a resinous substrate, or the like.

Modified Example 10

The method of performing the power-off process and the power-on process is embodied by software of a program executed by the CPU 171, but may be embodied by hardware. For example, the power-off process and the power-on process may be performed by an integrated circuit such as an ASIC (Application Specific IC). Further, the power-off process and the power-on process may be performed by the combination of the software and the hardware.

Modified Example 11

The printing apparatus is not limited to the serial printer, but may be a line printer or a page printer. In addition, the type of the printer is not limited to the ink jet printer, but may be a dot-impact printer, a thermal printer, a laser printer, or the like.

The technical spirit obtained by the embodiment and the modified examples will be described as below.

(1) The printing apparatus according to the first aspect is provided, wherein the abnormal state detecting section detects an abnormal state where the power-off operation cannot be performed or an abnormal state where the power-off operation is not normally performed.

(2) The printing apparatus according to the technical spirit (1) is provided, wherein in the power-off operation, an operation is performed which determines whether the tray is located at the normal position and moves the tray to the normal position by using the tray moving section when the tray is not located at the normal position.

(3) The printing apparatus according to the technical spirit (1) or (2) is provided, wherein in the power-off operation, an operation is performed which ensures the movement path of the tray so that the tray is movable thereon.

(4) The printing apparatus according to the first aspect is provided, wherein a printing process is performed on the printing medium set on the tray in such a manner that the printing medium is transported by moving the tray.

What is claimed is:

1. A printing apparatus which includes a tray for setting a printing medium thereon and performs an initialization process upon turning on the printing apparatus, the printing apparatus comprising:

an abnormal state detecting section which detects an abnormal state upon performing a power-off process;

a first information storing section which stores a detection result of the abnormal state detecting section as first information;

a tray position state detecting section which detects a position state of the tray;

a tray moving section which moves the tray to a normal position in the case where the position state of the tray is abnormal on the basis of a detection result of the tray position state detecting section upon turning on the printing apparatus;

a second information storing section which stores the detection result of the tray position state detecting section as second information; and an initialization process performing section which performs a second initialization process, in which a part of initialization items are omitted among plural initialization items of a first initialization process to be performed when the first information is abnormal, in the case where the first information is normal and the second information is abnormal.

2. The printing apparatus according to claim 1, wherein in the second initialization process, the initialization process performing section omits an initialization item which is guaranteed when the tray is movable to the normal position.

3. The printing apparatus according to claim 1, wherein in the case where the first information is normal and the second information is normal, the initialization process performing section performs a third initialization process in which a part of initialization items are omitted among the plural initialization items of the first initialization process, and wherein in the second initialization process, the initialization process performing section performs a part of initialization items among the initialization items omitted in the third initialization process.

4. The printing apparatus according to claim 3, further comprising:

a transport section which transports a second soft printing medium as the printing medium;

a common power source which drives the tray and the transport section;

a printing section which performs a printing process on a first printing medium and the second printing medium; and a position detecting section which is provided at a position capable of detecting the tray and the second printing medium, wherein the tray is used to set the first rigid printing medium as the printing medium thereon, wherein a movement path of the tray and a transport path of the second printing medium using the transport section are joined at a position right before the printing section so as to form a common path, and wherein the initialization item omitted in the third initialization process and performed in the second initialization process is a discharge reset operation of driving the power source so as to perform a discharge operation using the transport section and checks whether the transport path is empty after the discharge operation on the basis of a detection result of the position detecting section.

5. The printing apparatus according to claim 1, wherein the abnormal state detecting section detects the abnormal state when at least one of a fatal error, a plug-out state, and a power-off failure is generated.

6. The printing apparatus according to claim 4, further comprising:

a gap adjusting section which moves the printing section so as to adjust a gap between the printing section and the printing medium, wherein the initialization item omitted when the tray is movable to the normal position is a gap adjusting section reset operation of retreating the printing section to an end position so as not to interfere with the tray.

7. The printing apparatus according to claim 4, further comprising:

a discharge opening adjusting section which moves a movable member, adjusting a height of a discharge opening used to discharge the printing medium having been subjected to the printing process of the printing section, in a thickness direction of the printing medium, wherein the initialization item omitted when the tray is movable to the normal position is a discharge opening adjusting section reset operation of retreating the movable member to an end position so as not to interfere with the tray.

8. An initialization method of a printing apparatus which includes a tray for setting a printing medium thereon and performs an initialization process upon turning on the printing apparatus, the initialization method comprising:

an abnormal state detecting step of detecting an abnormal state upon performing a power-off process;

a first storage step of storing a detection result of the abnormal state detecting step as first information in a first information storing section;

a tray position state detecting step of detecting a position state of the tray upon turning on the printing apparatus;

a tray moving step of moving the tray to a normal position in the case where the position state of the tray is abnormal on the basis of a detection result of the tray position state detecting step;

a second storage step of storing the detection result of the tray position state detecting step as second information in a second information storing section; and an initialization process performing step of performing a second initialization process, in which a part of initialization items are omitted among plural initialization items of a first initialization process to be performed when the first information is abnormal, in the case where the first information is normal and the second information is abnormal.

* * * * *